US010589349B2

(12) United States Patent
Demetriou et al.

(10) Patent No.: US 10,589,349 B2
(45) Date of Patent: Mar. 17, 2020

(54) PRODUCTION OF METALLIC GLASS OBJECTS BY MELT DEPOSITION

(71) Applicant: Glassimetal Technology, Inc., Pasadena, CA (US)

(72) Inventors: Marios D. Demetriou, West Hollywood, CA (US); Joseph P. Schramm, Sierra Madre, CA (US); Georg Kaltenboeck, Pasadena, CA (US); William L. Johnson, San Marino, CA (US)

(73) Assignees: Glassimetal Technology, Inc., Pasadena, CA (US); Apple Inc., Cupertino, CA (US)

( * ) Notice: Subject to any disclaimer, the term of this patent is extended or adjusted under 35 U.S.C. 154(b) by 990 days.

(21) Appl. No.: 15/085,614

(22) Filed: Mar. 30, 2016

(65) Prior Publication Data

US 2016/0339509 A1 Nov. 24, 2016

Related U.S. Application Data

(60) Provisional application No. 62/140,355, filed on Mar. 30, 2015.

(51) Int. Cl.

| | |
|---|---|
| ***B22D 11/00*** | (2006.01) |
| ***B22D 11/055*** | (2006.01) |
| ***B22D 11/059*** | (2006.01) |

(52) U.S. Cl.

CPC ..... *B22D 11/001* (2013.01); *B22D 11/006* (2013.01); *B22D 11/055* (2013.01); *B22D 11/059* (2013.01)

(58) Field of Classification Search

CPC ..... B22D 11/00; B22D 11/001; B22D 11/006; B22D 11/055; B22D 11/059

USPC ..... 164/437, 488, 423, 463, 479

See application file for complete search history.

(56) References Cited

U.S. PATENT DOCUMENTS

| | | | | |
|---|---|---|---|---|
| 4,290,476 | A | 9/1981 | Smith | |
| 4,582,117 | A * | 4/1986 | Kushnick | B22D 27/08 164/423 |
| 8,052,923 | B2 | 11/2011 | Langlet | |
| 8,485,245 | B1 | 7/2013 | Prest et al. | |

(Continued)

FOREIGN PATENT DOCUMENTS

| | | |
|---|---|---|
| JP | 60-137552 | 7/1985 |
| JP | 62-183944 | 8/1987 |

(Continued)

OTHER PUBLICATIONS

Pond et al., "A Method of Producing Rapidly Solidified Filamentary Castings," *Transactions of the Metallurgical Society of AIME*, 1969, vol. 245, No. 11, pp. 2475.

(Continued)

*Primary Examiner* — Kevin P Kerns
(74) *Attorney, Agent, or Firm* — Polsinelli PC

(57) ABSTRACT

Methods and apparatus for forming high aspect ratio metallic glass objects, including metallic glass sheets and tubes, by a melt deposition process are provided. In some methods and apparatus a molten alloy is deposited inside a channel formed by two substrates moving relative to each other, and shaped and quenched by conduction to the substrates in a manner that enables the molten alloy to vitrify without undergoing substantial shear flow.

20 Claims, 15 Drawing Sheets

(56) References Cited

U.S. PATENT DOCUMENTS

| | | | |
|---|---|---|---|
| 2003/0183310 | A1 | 10/2003 | McRae |
| 2013/0306198 | A1 | 11/2013 | Prest et al. |
| 2013/0309121 | A1 | 11/2013 | Prest et al. |
| 2014/0202595 | A1 | 6/2014 | Hofmann |
| 2015/0090371 | A1 | 4/2015 | Demetriou et al. |
| 2016/0023438 | A1 | 1/2016 | Johnson et al. |

FOREIGN PATENT DOCUMENTS

| | | |
|---|---|---|
| JP | H04 198436 | 7/1992 |
| WO | WO 2013/089651 | 6/2013 |

OTHER PUBLICATIONS

M.D. Demetriou et al., "A damage-tolerant glass," *Nature Materials*, 2011 vol. 10, pp. 123-128.

Chen et al., "A Rapid Quenching Technique for the Preparation of Thin Uniform Films of Amorphous Solids," *Review of Scientific Instruments*, 1970, vol. 41, No. 8, pp. 1237-1238.

S. Pauly et al., "Processing Metallic Glasses by Selective Laser Melting," *Materials Today*, vol. 16, pp. 37-41 (2013).

Y.J. Kim et al., "Experimental determination of the time-temperature-transformation diagram of the undercooled liquid $Zr_{41.2}Ti_{13.8}Cu12.5Ni_{10}Be22.5$ alloy using containerless electrostatic levitation processing," *Appl. Phys. Lett.*, 68, 1057-1059 (1996).

S. Pogatscher et al., "In-Situ Probing of Metallic Glass Formation and Crystallization upon Heating and Cooling via Fast Differential Scanning Calorimetry," *Appl. Phys*. Lett. 104, 251908 (2014).

V.K. Valla et al., "Laser Processing of Fe-based Bulk Amorphous Alloy," *Surface & Coatings Technology*, 205, 2661-2667 (2010).

G. Yang et al., "Laser Solid Forming of Zr-Based Bulk Metallic Glass," *Intermetallics* 22, 110-115 (2012).

J.Y. Suh et al., "Novel Thermoplastic Bonding Using a Metallic Glass Solder," *Scripta Materialia* 59, 905-908 (2008).

J.G. Wang et al., "Diffusion Bonding of a Zr-based Metallic Glass in its Supercooled Liquid Region," *Intermetallics* 46, 236-242 (2014).

J. Schroers et al., "Pronounced asymmetry in the crystallization behavior during constant heating and cooling of a bulk metallic glass-forming liquid," *Phys. Rev. B*. vol. 60, No. 17, 11855 (1999).

F. Incropera and D.P. DeWitt, "Fundamentals of Heat and Mass Transfer," 3rd Edition, 1990, p. 262.

S. Ding et al., "Wetting of Bulk Metallic Glass Forming Liquids on Metals and Ceramics," Journal of Applied Physics, vol. 245, Issue 110, 043508 (2011).

* cited by examiner

PRODUCTION OF METALLIC GLASS OBJECTS BY MELT DEPOSITION

CROSS-REFERENCE TO RELATED APPLICATION(S)

The present application claims the benefit under 35 U.S.C. § 119(e) of U.S. Provisional Patent Application No. 62/140,355, entitled "Production of Metallic Glass Objects by Melt Deposition," filed on Mar. 30, 2015, which is incorporated herein by reference in its entirety.

FIELD

The disclosure is directed to a method of producing metallic glass objects by a melt deposition method, and an apparatus for performing such melt deposition forming methodologies.

BACKGROUND

Several conventional methods for producing metallic glass sheets exist. Most of these conventional methods achieve vitrification of the formed sheet by quenching an alloy melt from a high temperature while the melt simultaneously undergoes shear or flow. One conventional method is melt spinning (also known as planar flow casting), in which the melt is injected on a thermally conducting roller rotating at high speed (see, for example, R. Pond and R. Maddin, "A Method of Producing Rapidly Solidified Filamentary Castings", Transactions of the Metallurgical Society of AIME, Volume: 245, Issue: 11, Page: 2475, 1969).

Another conventional method is twin-roll sheet forming, in which the melt is poured into the gap between a set of rotating thermally-conducting rollers (see, for example, H. S. Chen and Miller C. E. Miller, "A Rapid Quenching Technique for the Preparation of Thin Uniform Films of Amorphous Solids", Review of Scientific Instruments, Volume: 41, Issue: 8, Pages: 1237-1238, 1970).

There is a need for a method that achieves formation of metallic glass sheets, tubes, and other objects that have thicknesses not limited to the micrometer scale, have improved thickness uniformity, and are substantially free from any crystallinity.

SUMMARY

The disclosure is directed to methods and apparatus for forming metallic glass objects by a melt deposition process. In many embodiments, the methods and apparatus are provided to forming metallic glass objects. In some embodiments the methods and apparatus provided are directed to forming metallic glass sheets in accordance with a melt deposition process. In other embodiments methods and apparatus are provided for forming metallic glass tubes by a melt deposition process.

In some embodiments, an apparatus is provided for forming a high aspect ratio metallic glass object.

In many embodiments, the apparatus includes a first substrate and a second substrate, where the first and second substrates are separated from each other by a gap of thickness t, and where the first substrate and the second substrate are configured to move relative to each other at a velocity $V_o$.

In many other embodiments, the substrates and the gap are configured to form a channel having thickness t and width w defined by an overlapping cross section of the substrates perpendicular to $V_o$. In some embodiments, a molten alloy, capable of forming the high aspect ratio metallic glass object can be extracted along the overlapping cross section and deposited at constant deposition rate into the channel at a contact temperature with each substrate.

In yet many other embodiments, the first substrate has a thermal conductivity of at least 10 W/m-K, and the second substrate has a contact angle with the molten alloy capable of forming the metallic glass object of more than 90° at the contact temperature.

In yet many other embodiments, wherein first substrate has a thermal conductivity of at least 20 W/m-K, and the second substrate has a contact angle with the molten alloy capable of forming the metallic glass object of more than 120° at the contact temperature.

In yet many other embodiments, the second substrate has a surface roughness in the contact surface with the melt having an average surface asperity height of less than 1 μm.

In some embodiments, melt is extracted from a melt reservoir through a nozzle.

In still many other embodiments, at least one of the first and second substrates cools the molten alloy rapidly.

In still many other embodiments, the gap thickness t is less than $\sqrt{(\alpha \cdot \tau_{cr})}$, where $\alpha$ is the thermal diffusivity of the melt and $\tau_{cr}$ is the minimum crystallization time of the metallic glass alloy.

In still many other embodiments, the gap thickness t is less than the critical casting thickness of the alloy.

In still many other embodiments, the gap thickness t is in the range of 0.1 mm to 1 mm.

In still many other embodiments, the relative velocity $V_o$ is in the range of $0.1\alpha/t$ to $10000\alpha/t$.

In still many other embodiments, the deposition rate Q is in the range of $0.1\alpha w$ to $10000\alpha/w$.

In still many other embodiments, the relative velocity $V_o$ is in the range of 0.1 mm/s to 10 m/s.

In still many other embodiments, the deposition rate Q is in the range of $10^{-10}$ $m^3/s$ to $10^{-2}$ $m^3/s$.

In still many other embodiments, the melt temperature of the alloy prior to being deposited is heated to a temperature of at least 100° C. higher than $T_L$.

In yet many other embodiments, the molten alloy may be deposited at a constant deposition rate Q that does not vary by more than 20% of a product ($V_o \times t \times w$). In some embodiments, the deposition rate Q does not vary by more than 10% of a product ($V_o \times t \times w$). In still other embodiments, the deposition rate Q does not vary by more than 5% of a product ($V_o \times t \times w$).

In still yet many other embodiments, the first and second substrates are at a temperature below the glass-transition temperature of the metallic glass In some embodiments, a method is provided for forming a metallic glass sheet.

In many embodiments the method includes depositing a molten alloy capable of forming the metallic glass sheet at a deposition rate Q in a gap of thickness t separating two substrates that have plate-like geometry.

In many other embodiments, the substrates are configured to move relatively to each other at a velocity $V_o$, and the molten alloy is extracted along an overlapping cross section having width w that is perpendicular to $V_o$. In some embodiments, the molten alloy is extracted from a melt reservoir through a nozzle.

In still many other embodiments, a constant deposition rate is achieved by means of an actuator, wherein the actuator comprises a plunger drive having cross sectional area $A_p$ moving at a velocity $V_p$, wherein $V_p$ is within 50% of the value $(V_o \times t \times w)/A_p$.

In still many other embodiments, the molten alloy is shaped and quenched by thermal conduction to at least one of the substrates in a manner that enables the melt to vitrify, i.e. to transform to the metallic glass phase, without undergoing shear flow.

In still many other embodiments, the molten alloy is shaped and quenched by thermal conduction to at least one of the substrates in a manner such that the skin friction coefficient at the interface between the melt and the stationary surface is effectively zero.

In some embodiments, methods and apparatus for forming metallic glass tube by a melt deposition process are provided.

In many other embodiments, a molten alloy is deposited at a constant deposition rate Q inside a channel of thickness t formed by two substrates having tubular geometry. In some such embodiments, the substrates are configured to move relative to each other at a velocity $V_o$.

In other embodiments, the apparatus includes an interior tubular substrate and an exterior tubular substrate, where the interior and exterior substrates are arranged concentrically such that they are separated from each other by a gap of thickness t, and where the interior tubular substrate and the exterior tubular substrate are configured to move relative to each other at a velocity $V_o$. In some embodiments, a melt reservoir can be configured to be in fluid communication with the gap.

In many embodiments, the apparatus and method allows a melt of metallic glass to be deposited and formed while being quenched, without undergoing shear flow.

Additional embodiments and features are set forth in part in the description that follows, and in part will become apparent to those skilled in the art upon examination of the specification or may be learned by the practice of the disclosure. A further understanding of the nature and advantages of the disclosure may be realized by reference to the remaining portions of the specification and the drawings, which forms a part of this disclosure.

BRIEF DESCRIPTION OF THE DRAWINGS

The description will be more fully understood with reference to the following figures and data graphs, which are presented as various embodiments of the disclosure and should not be construed as a complete recitation of the scope of the disclosure.

DETAILED DESCRIPTION

The disclosure is directed to methods and apparatus for forming metallic glass objects, such as metallic glass sheets or tubes, by melt deposition processes. In many embodiments, the methods and apparatus incorporate melt deposition processes in which a molten alloy is deposited inside a channel formed by two substrates moving relatively to each other, and shaped by achieving traction with one of the substrates while slipping over the other substrate, and quenched by conducting heat to at least one of the substrates in a manner that enables the melt to vitrify, i.e. to transform to the metallic glass phase. In some embodiments, the deposition method allows the melt to be deposited and formed while being quenched without undergoing shear flow.

Conventional methods for forming high aspect ratio metallic glass objects, such as metallic glass sheets, typically involve a process where melt shear flow and melt quenching are coupled. Specifically, in these methods the melt is shaped into a sheet by undergoing shear flow while simultaneously being quenched. The coupling between shear flow and quenching gives rise to complications that hinder the development of the metallic glass sheet. For example, the complications include lack of uniformity of the formed metallic glass sheet, production of surface defects, and crystallization. Specifically:

- The melt cooling process dynamically increases the melt viscosity such that the shear flow process is dynamically slowed resulting in difficulty in controlling the thickness of the sheet;
- The coupling between cooling and shearing gives rise to shear banding as the glass transition is approached, which may result in the production of tears, cracks, or other structural defects in the sheet; and
- Shear flow is also found to accelerate the rate of crystallization and consequently crystallites may evolve as the material is cooled through its undercooled region.

The above complications, which are direct consequences of the coupling between cooling and shearing of the melt inherent in these conventional methods, contribute to the lack of a commercially-robust sheet fabrication process for metallic glasses.

Melt flow between two substrates moving relative to each other can result in various flow profiles, depending on the boundary conditions (i.e. the interaction between melt and substrates) as well as the net applied pressure $\Delta P$ (i.e. the difference between the applied pressure behind the flow and the ambient pressure ahead of the flow) on the melt. Some possible flow profiles are presented below for the non-limiting example of one moving substrate (with velocity $V=V_o$) and one the stationary substrate (with $V=0$).

Figure 1A:
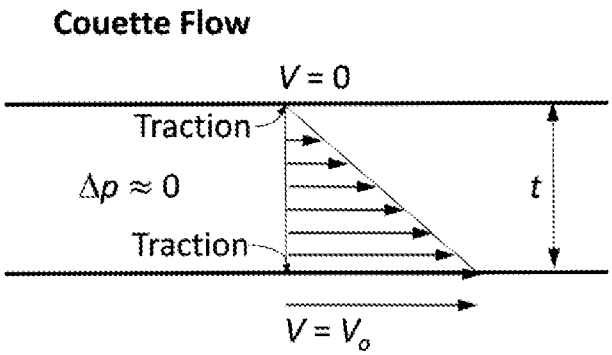
FIGS. 1*a* to 1*c* provide schematics describing various flow patterns in accordance with embodiments of the disclosure.

One possible velocity profile is Couette flow, shown schematically in FIG. 1*a*. This profile may arise when the melt attains traction with the moving substrate as well as the stationary substrate, and when the net applied pressure is approximately zero (i.e. $\Delta P \approx 0$). In this profile, the melt velocity at the interface with the moving substrate would be approximately $V_o$, at the interface with the stationary substrate would be approximately zero, while between the substrates it would vary between zero and $V_o$ in an approximately linear function with the channel thickness coordinate. The average melt velocity in this profile is approximately 50% of $V_o$, while the shearing rate is approximately constant across the channel thickness t and approximately equal to $V_o/t$.

Figure 1B:
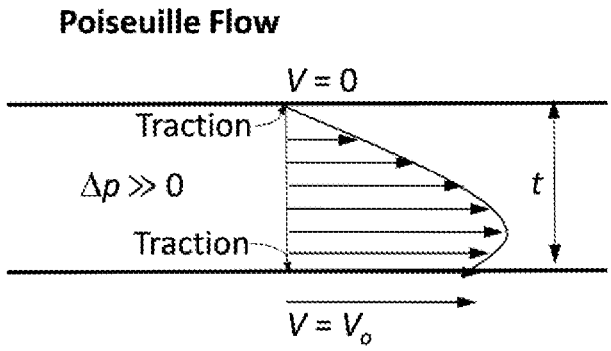

Another possible velocity profile is Poiseuille flow, shown schematically in FIG. 1*b*. This profile may arise when the melt attains full or partial traction or full or partial slipping with either substrate (the case of full traction with both substrates is illustrated in FIG. 1*b*), and when the net applied pressure is considerably greater than zero (i.e. $\Delta P >> 0$). In this profile, the melt velocity at the interface with either substrate would depend on the boundary conditions (full or partial traction or full or partial slipping), however, the melt velocity in between the substrates would vary with the channel thickness coordinate according to a polynomial function, and would attain a maximum value at some intermediate distance that is greater than either boundary velocities. The average melt velocity in this profile is greater than 50% of $V_o$, while the shearing rate would vary across the channel thickness t and would have a maximum value at one of the interfaces that is greater than $V_o/t$.

Figure 1C:
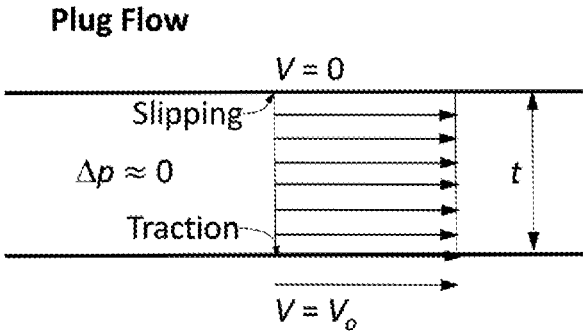

Another possible velocity profile is plug flow, shown schematically in FIG. 1*c*. This profile may arise when the melt attains traction with the moving substrate and undergoes slipping with the stationary substrate, and when the net applied pressure is very small or approximately zero (i.e. $\Delta P \approx 0$). In this profile, the melt velocity at the interface with both the moving as well as the stationary substrate would be approximately $V_o$, while between the substrates it would also be approximately equal to $V_o$. The average melt velocity in this profile is also approximately $V_o$, while the shearing rate is approximately zero. In this profile, the skin friction coefficient $c_f$ at the interface between the melt and the stationary surface is very small or approximately zero (i.e. $c_f \approx 0$).

Definitions

According to many embodiments of methods and apparatus for performing melt deposition processes presented herein, the deposition method allows the melt to be deposited between a moving and a stationary substrate in a manner that develops a velocity profile that resembles "plug flow," that is, without undergoing shear flow to form objects and/or where the skin friction coefficient at the interface between the melt and the stationary surface is effectively zero. Quenching of the substrate by conduction and/or convection with at least one of the substrates also renders the formed objects amorphous. In some embodiments the amorphous objects are high aspect ratio parts, such as metallic glass sheets and tubes.

It should be understood that in the context of the disclosure, the term 'without undergoing shear flow' refers to shearless melt deposition processes in which the melt shearing rate between the substrates is substantially low or approximately zero. In some embodiments, the melt shearing rate between the substrates is less than $V_o/t$. In other embodiments, the melt shearing rate between the substrates is less than $0.5\ V_o/t$. In other embodiments, the melt shearing rate between the substrates is less than $0.1\ V_o/t$. In other embodiments, the melt shearing rate between the substrates is less than $0.01\ V_o/t$. In other embodiments, the melt shearing rate between the substrates is less than $100\ s^{-1}$. In other embodiments, the melt shearing rate between the substrates is less than $10\ s^{-1}$. In other embodiments, the melt shearing rate between the substrates is less than $1\ s^{-1}$. In other embodiments, the melt shearing rate between the substrates is less than $0.1\ s^{-1}$. In yet other embodiments, the melt shearing rate between the substrates is less than $0.01\ s^{-1}$. In yet other embodiments, the melt shearing rate between the substrates is less than $0.001\ s^{-1}$.

It should be understood that in the context of the disclosure, the term 'effectively zero skin friction coefficient' refers to shearless melt deposition processes in which the skin friction coefficient at the interface between the melt and the stationary surface is approximately zero or very small. In some embodiments, the skin friction coefficient at the interface between the melt and the stationary surface is less than $\eta/\rho V_o t$, where $\eta$ is the melt viscosity and p is the melt density. In other embodiments, the skin friction coefficient at the interface between the melt and the stationary surface is less than $0.1\eta/\rho V_o t$. In other embodiments, the skin friction coefficient at the interface between the melt and the stationary surface is less than $0.01\eta/\rho V_o t$. In other embodiments, the skin friction coefficient at the interface between the melt and the stationary surface is less than 0.1. In other embodiments, the skin friction coefficient at the interface between the melt and the stationary surface is less than $0.01\ s^{-1}$. In other embodiments, the skin friction coefficient at the interface between the melt and the stationary surface is less than 0.001. In other embodiments, the skin friction coefficient at the interface between the melt and the stationary surface is less than 0.0001. In yet other embodiments, the skin friction coefficient at the interface between the melt and the stationary surface is less than 0.00001.

It should be understood that in the context of the disclosure, the term 'constant deposition rate' refers to a deposition rate that does not substantially vary over time. In some embodiments, 'constant deposition rate' means a deposition rate that does not vary by more than 50% over time. In other embodiments, 'constant deposition rate' means a deposition rate that does not vary by more than 20% over time. In yet other embodiments, 'constant deposition rate' means a deposition rate that does not vary by more than 10% over time. In yet other embodiments, 'constant deposition rate' means a deposition rate that does not vary by more than 5% over time.

It should be understood that in the context of the disclosure, the terms 'the net applied pressure is approximately zero (i.e. $\Delta P \approx 0$)' and 'a small net positive applied pressure $\Delta P$' refer to a net applied pressure that, in some embodiments, is less than 10% of the product between the melt density and average melt velocity squared, or in other embodiments, less than 5% of the product between the melt density and average melt velocity squared, or in yet other embodiments, less than 1% of the product between the melt density and average melt velocity squared. Also, the term 'the net applied pressure is considerably greater than zero (i.e. $\Delta P>>0$)' refers to a net applied pressure that, in some embodiments, is greater than 50% of the product between the melt density and average melt velocity squared, or in other embodiments, is greater than 100% of the product between the melt density and average melt velocity squared, or in yet other embodiments, is greater than 500% of the product between the melt density and average melt velocity squared It should be understood that in the context of the disclosure, the term 'substrates' refers to objects that can have any arbitrary shape; however, they include surfaces with matching contours such that they can be arranged with mating surfaces facing each other in parallel at a gap distance t to form a channel of thickness t. In other words, the thickness of the channel is approximately equal to the gap distance between the mating surfaces of the substrates. In some embodiments, the substrate may be a conveyor belt.

In some embodiments, the substrates can have plate-like shape to form metallic glass sheets. In other embodiments, the substrates can have tubular geometry to form metallic glass tubes. In other embodiments, the substrate can have an arc-shape geometry. In still other embodiments, it should be understood any geometry or arrangement of substrates may be provided such that a channel suitable for melt deposition is formed therebetween.

In the context of the disclosure, the thickness t is uniform such that it does not vary by more than 10% at any two locations along the gap. In some embodiments, the thickness t does not vary by more than 5% at any two locations along the gap. In yet other embodiments, the thickness t does not vary by more than 1% at any two locations along the gap.

It should be understood that in the context of the disclosure, a high aspect ratio metallic glass object refers to a metallic glass object that can have any arbitrary shape; however, the smallest dimension of the object is equal to or less than 20% of any of the larger dimensions of the object. In some embodiments, the smallest dimension of the high aspect ratio metallic glass object is equal to or less than 10% of any of the larger dimensions of the object. In other embodiments, the smallest dimension of the high aspect ratio object is equal to or less than 5% of any of the larger dimensions of the object. In some embodiments, a high aspect ratio metallic glass sheet would have a thickness that is equal to or less than 20% of its width and length. In another embodiment, a high aspect ratio metallic glass tube would have a wall thickness that is equal to or less than 20% of the tube inner diameter or outer diameter, and the tube length.

Flow Configurations

Figure 2:
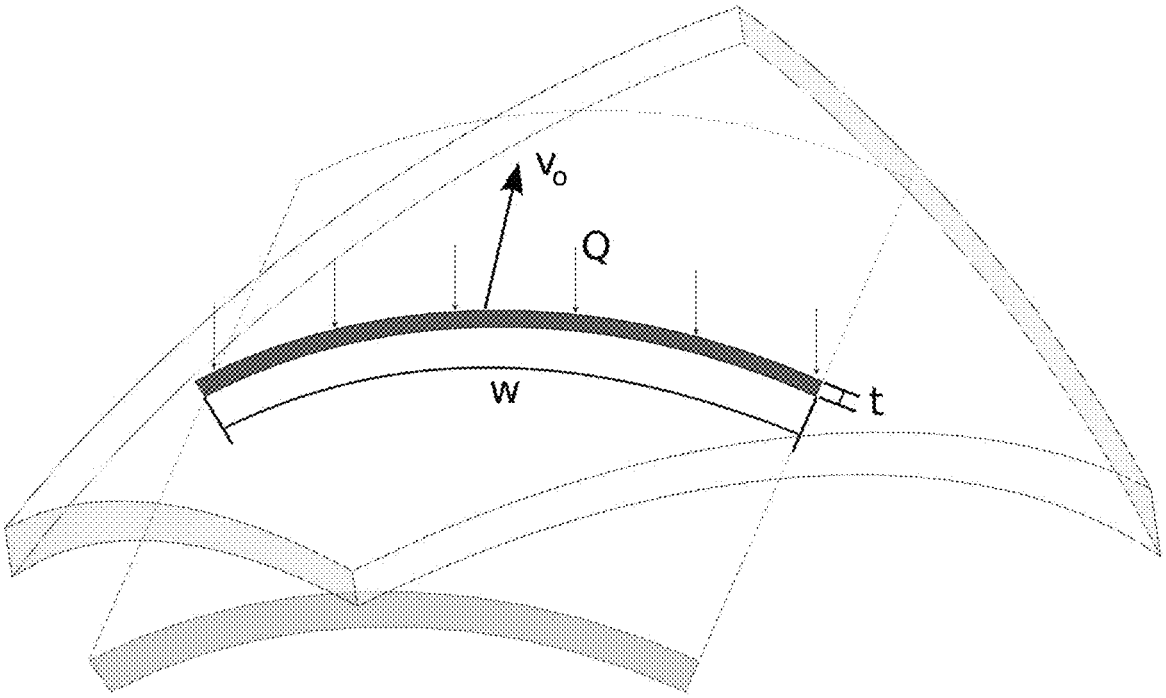
FIG. 2 provides a schematic describing the general method of forming a metallic glass object in accordance with embodiments of the disclosure.

As illustrated in FIG. 2, many embodiments disclose methods and apparatus for forming a metallic glass object of thickness t and width w by employing two substrates separated by a gap t, arranged parallel to each other, where one substrate is movable relative to the other substrate such that a relative velocity $V_o$ is established between the substrates. In particular, w represents the overlapping width perpendicular to the direction of $V_o$. In embodiments of such a process or apparatus, the molten alloy capable of forming metallic glass is extracted along w and deposited between the substrates at a deposition rate Q (in $m^3/s$). In some embodiments, the deposition rate Q is constant. As shown in FIG. 2, the melt may be injected along any overlapped section at any angle.

A metallic glass formed according to this method will have thickness t and will be shaped according to the shape of the channel formed by the mating surfaces of the substrates. In other words, the thickness t of the metallic glass is equal to the thickness t of the channel (i.e. the variations between the metallic glass and channel thickness are less than 10% and in some embodiments less than 5%).

Figure 3:
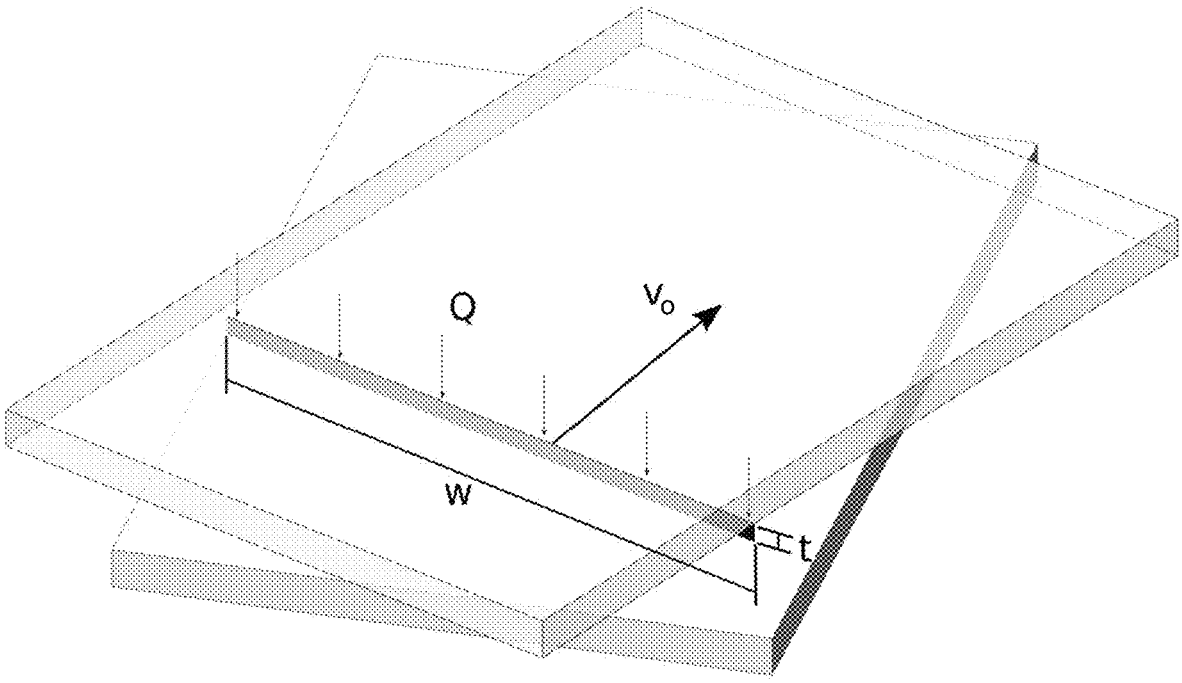
FIG. 3 provides a schematic illustrating the method to produce a flat sheet in accordance with embodiments of the disclosure.

In some embodiments, the mating substrates are planar and flat, and a metallic glass sheet is formed that is likewise planar and flat. This embodiment is illustrated schematically in FIG. 3. As shown in FIG. 3, in such embodiments the molten alloy may be injected along any overlapped section at any angle, and having any dimensions (thickness t or width w) suitable.

Figure 4:
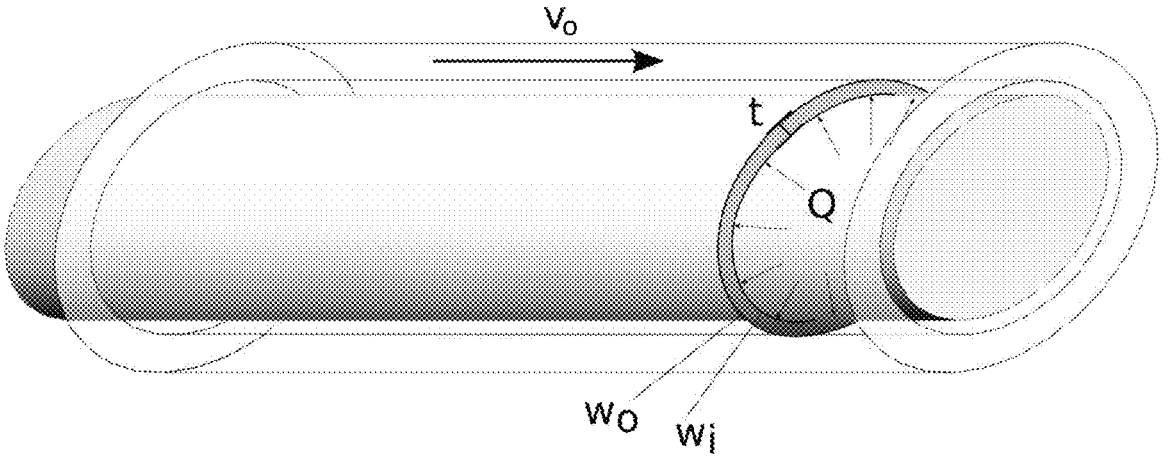
FIG. 4 provides a schematic describing the general method of forming a metallic glass tube in accordance with embodiments of the disclosure.

In other embodiments, as illustrated in FIG. 4, the disclosed methods involve forming a metallic glass tube of wall thickness t and exterior and interior circumferences $w_o$ and $w_i$ by employing two tubular shaped substrates, where the interior circumference of one of the substrates $w_o$ (exterior substrate) is larger than the exterior circumference of the other substrate $w_i$ (interior substrate), i.e. $w_0>w_i$ arranged concentrically with the interior substrate inside the exterior substrate such that they are separated by a gap t, and where one substrate is movable relative to the other substrate such that a relative velocity $V_o$ is established between the substrates. In many such embodiments, the exterior and interior substrates include tubular or tube-like exterior and interior surfaces that can be arranged concentrically with the mating surfaces facing each other in parallel at a gap t to form an annular channel of thickness t. A tube formed according to this method will have thickness t and will be shaped according to the shape of the channel formed by the mating surfaces of the substrates. In other words, the wall thickness t of the metallic glass tube is equal the thickness t of the annular channel (i.e. the variations between the metallic glass tube and annular channel thickness are less than 10% and in some embodiments less than 5%). In this process, the molten alloy capable of forming metallic glass is extracted along $w_o$ or $w_i$ and deposited between the substrates at a deposition rate Q (in $m^3/s$). In some embodiments, the deposition rate Q is constant.

In some embodiments of the disclosure, the interior substrate is a solid rod-like shape. In other embodiments, the concentric substrates are circular and the metallic glass tube formed is likewise circular. In other embodiments, the concentric substrates can be elliptical and the metallic glass tube formed is likewise elliptical.

Some parameters can be adjusted in embodiments of the apparatus and method, including the materials of the substrates, the shape of the substrates, the surface roughness of the substrates, the contact angle between the substrates and the melt, the temperature of the substrates, the thickness t, the width w, the relative velocity between the substrates $V_o$, and the deposition rate Q.

Boundary Conditions to Achieve "Shearless" Plug Flow

In embodiments of the apparatus and method of the disclosure, the flow of a molten alloy capable of forming metallic glass deposited between two substrates that move relative to each other can approach the condition of "shearless" plug flow when it attains traction with one of the substrates and slipping with the other substrate. In the context of the disclosure, the substrate which the melt attains traction with is referred to as the "chill substrate," while the substrate which the melt is slipping over is referred to as the "guide substrate."

One way to achieve either traction or slipping of a melt of a certain composition with a specific substrate is by promoting or avoiding wetting, respectively. Wetting is generally characterized by the contact angle between the melt and substrate: small contact angles between 0° and 90° designate good wetting (with 0° contact angle designating full wetting), while large contact angles between 90° and 180° designate poor wetting (with 180° contact angle designating no wetting). Wetting is also a function of the contact temperature; generally, the higher the contact temperature, the better the wetting. Various studies of quantifying wetting between metallic glass-forming melts and various substrates by determining the contact angle at various melt temperatures have been published (see, for example, S. Ding, J. Kong, and J. Schroers, "Wetting of Metallic Glass Forming Liquids on Metals and Ceramics", Journal of Applied Physics, Volume: 245, Issue: 110, 043508, 2011).

In embodiments of the apparatus and method of the disclosure, a molten alloy capable of forming metallic glass demonstrates good wetting with the chill substrate at the contact temperature. In some embodiments, a molten alloy capable of forming metallic glass has a contact angle with the chill substrate of less than 90° at the contact temperature, while in other embodiments a contact angle of less than 60°, while yet in other embodiments a contact angle of less than 30°, while yet in other embodiments a contact angle of less than 20°, and while yet in other embodiments a contact angle of less than 10°. In other embodiments of the apparatus and method of the disclosure, a molten alloy capable of forming metallic glass demonstrates poor wetting with the guide substrate at the contact temperature. In some embodiments, a molten alloy capable of forming metallic glass has a contact angle with the guide substrate of more than 90° at the contact temperature, while in other embodiments a contact angle of more than 120°, while yet in other embodiments a contact angle of more than 150°, while yet in other embodiments a contact angle of more than 160°, and while yet in other embodiments a contact angle of more than 170°.

Another way to achieve either traction or slipping between a melt and a specific substrate is by encouraging or introducing or removing surface roughness, respectively. A high surface roughness, characterized by tall asperities, promotes traction with the melt by encouraging friction between the melt and the substrate. On the other hand, a low surface roughness, characterized by short asperities (i.e. as in a highly polished surface), promotes slipping by reducing friction, and specifically by reducing the skin friction coefficient $c_f$, between the melt and the substrate.

In embodiments of the apparatus and method of the disclosure, the chill substrate has a high surface roughness in the contact surface with the melt. In some embodiments, the average surface asperity height on a chill substrate is more than 1 μm, while in other embodiments more than 5 μm, while yet in other embodiments more than 10 μm, and while yet in other embodiments more than 20 μm. In other embodiments of the apparatus and method of the disclosure, the guide substrate has a low surface roughness in the contact surface with the melt. In some embodiments, the average surface asperity height on a guide substrate is less than 1 μm, while in other embodiments less than 0.5 μm, while yet in other embodiments less than 0.1 μm, while yet in other embodiments less than 0.05 μm.

In embodiments of the apparatus and method of the disclosure, a molten alloy capable of forming metallic glass exchanges heat by conduction with at least one of the substrates.

In other embodiments of the apparatus and method of the disclosure, a molten alloy capable of forming metallic glass exchanges heat by conduction and convection with at least one of the substrates.

In some embodiments, at least one of the substrates has a thermal conductivity of at least 10 W/m-K. In another embodiment, at least one of the substrates has a thermal conductivity of at least 20 W/m-K. In another embodiment, at least one of the substrates has a thermal conductivity of at least 50 W/m-K. In another embodiment, at least one of the substrates has a thermal conductivity of at least 80 W/m-K.

In other embodiments, the chill substrate has a thermal conductivity of at least 10 W/m-K. In another embodiment, the chill substrate has a thermal conductivity of at least 20 W/m-K. In another embodiment, the chill substrate has a thermal conductivity of at least 50 W/m-K. In another embodiment, the chill substrate has a thermal conductivity of at least 80 W/m-K.

Flow Rate to Achieve "Shearless" Plug Flow

In embodiments of the apparatus and method of the disclosure, the flow of a molten alloy capable of forming metallic glass deposited between two substrates that move relative to each other with a relative velocity $V_o$ forming a channel having thickness t and width w defined by an overlapping cross section of the substrates perpendicular to $V_o$ can approach the condition of "shearless" plug flow when the deposition rate Q (in $m^3/s$) matches the product ($V_o \times r \times w$), that is:

$$Q = V_o \times t \times w \quad \text{Eq. (1)}$$

In the case of tubular geometry, w is the mean tube circumference given by $w=(w_o+w_i)/2$.

In some embodiments, the deposition rate Q is equal to a product ($V_o \times r \times w$). In other embodiments, the deposition rate Q may vary from the product ($V_o \times r \times w$) by up to 20%. In yet other embodiments, the deposition rate Q may vary from the product ($V_o \times r \times w$) up to 10%. In other embodiments, the deposition rate Q may vary from the product ($V_o \times r \times w$) up to 5%.

Quench Rate to Achieve Formation of the Amorphous Phase

A "critical cooling rate," which is defined as the cooling rate required to avoid crystallization and form the amorphous phase (i.e. the metallic glass) on cooling the alloy from the high temperature melt, determines the "critical casting thickness," defined as the maximum thickness up to which an alloy is capable of forming the amorphous phase. The lower the critical cooling rate of an alloy, the larger its critical casting thickness. The critical cooling rate $R_c$ in K/s and critical casting thickness $t_c$ in mm are related via the approximate empirical equation $R_c=1000/t_c^2$. According to this equation, the critical cooling rate for an alloy having a critical casting thickness of 100 μm is about $10^5$ K/s, the critical cooling rate for an alloy having a critical casting thickness of 1 mm is about $10^3$ K/s, while the critical cooling rate for an alloy having a critical casting thickness of 10 m is about $10^1$ K/s.

Generally, three categories are known in the art for identifying the ability of a metal alloy to form glass (i.e. to bypass the stable crystal phase and form an amorphous phase). Metal alloys having critical cooling rates in excess of $10^{12}$ K/s are typically referred to as non-glass-formers, as it is physically impossible to achieve such cooling rates over a meaningful thickness (i.e. at least 1 micrometer). Metal alloys having critical cooling rates in the range of $10^5$ to $10^{12}$ K/s are typically referred to as marginal glass-formers, as they are able to form glass over thicknesses ranging from 1 to 100 micrometers (according to the empirical equation above). Metal alloys having critical cooling rates on the order of $10^3$ or less, and as low as 1 or 0.1 K/s, are typically referred to as bulk glass-formers, as they are able to form glass over thicknesses ranging from 1 millimeter to several centimeters. The glass-forming ability of a metallic alloy is, to a large extent, dependent on the composition of the alloy. The compositional ranges for alloys capable of forming marginal glass-formers are considerably broader than those for forming bulk glass-formers.

In various embodiments of the disclosure, the metallic glass-forming alloy is based on any of the following metals: Zr, Ti, Ta, Y, Hf, Ni, Pd, Pt, Fe, Ni, Co, Cu, Au, Al, La, Ce, Pr, Ng, Gd, Mg, Ca, or combinations thereof.

The gap between the substrates t, which also defines the sheet or tube wall thickness, can be influenced by proprieties of the metallic glass-forming alloy. In some embodiments, the thickness t can be set to be equal to or below the critical casting thickness of the alloy. In other embodiments, the thickness t can be set to be 50% of the critical casting thickness of the alloy. In yet other embodiments, the thickness t can be set to be 25% of the critical casting thickness of the alloy. In yet other embodiments, the thickness t can be set to be 10% of the critical casting thickness of the alloy.

The thermal relaxation time (also known as the Fourier number), $\tau_{th}$, is defined as the time required for the melt temperature to drop by about 1/e where e=2.71 is Euler's constant, i.e. about 37% of the temperature difference between the melt initial temperature and the substrate temperature. The thermal relaxation time can be determined from the thermal diffusivity of the alloy, a, and the thickness t as follows:

$$\tau_{th}=ct^2/\alpha \qquad \text{Eq. (2)}$$

where the constant c is determined by the boundary conditions. For the boundary conditions considered in the disclosure, c would vary approximately between 1 and 4 (see Examples).

The time for an undercooled metallic melt to crystallize, $\tau_{cr}$, varies with the temperature of the undercooled melt. The time to crystallize as a function of temperature is known as the Time-Temperature-Transformation (TTT) diagram. The crystallization time can be longer just below the liquidus temperature $T_L$ and just above the glass transition temperature $T_g$, and shorter at intermediate undercooling temperatures. As such, the TTT diagram exhibits a "C" shape, and the crystallization time crosses a minimum at a unique temperature in the undercooled region. This minimum crystallization time at the "nose" of the C-shaped curve is termed the "nose time" and is denoted by $\tau_{cr}$. The temperature associated with the minimum crystallization time is termed the "nose temperature" and is denoted by $T_{cr}$. For alloys capable of forming metallic glasses, the nose temperature is approximately 80% of the liquidus temperature (measured in Kelvin).

In some embodiments, if the thickness t is chosen such that the thermal relaxation time is less than the minimum crystallization time (i.e. $\tau_{th}<\tau_{cr}$), then the molten alloy can be deposited at a rate higher than the rate required to bypass the crystallization transition. In other embodiments, if the thickness t is chosen such $\tau_{th}$ approximately matches (i.e. within 20%, and in some embodiments within 10%) the time at which the molten alloy cools to the glass transition temperature, then the molten alloy would be deposited at the same rate as the rate required to form the metallic glass phase.

In certain embodiments, the thickness t can be selected based on the choice of the substrate materials, the thermal diffusivity of the molten alloy $\alpha$, and the minimum crystallization time of the metallic glass alloy $\tau_{cr}$. In some embodiments, both substrates may comprise a material with high thermal diffusivity (i.e. with thermal diffusivity greater than order of $10^{-4}$ $m^2/s$, such as copper). In such embodiments the constant c in Eq. (2) is approximately equal to 1, and the thickness t can be selected such that $t<\sqrt{(\alpha\cdot\tau_{cr})}$. In certain embodiments when such substrates are used, the thickness t can be selected to be less than the critical casting thickness of the alloy. In other embodiments, one substrate may comprise a material with high thermal diffusivity (i.e. with thermal diffusivity greater than order of $10^{-4}$ $m^2/s$, such as copper) and the other substrate may comprise a material with low thermal diffusivity (i.e. with thermal diffusivity less than order of $10^{-6}$ $m^2/s$, such as silicate glass). In such embodiments the constant c in Eq. (2) is approximately equal to 4, and the thickness t can be selected such that $t<0.5\sqrt{(\alpha\cdot\tau_{cr})}$. In certain embodiments when such substrates are used, the thickness t can be selected to be less than half of the critical casting thickness of the alloy. In yet other embodiments, the substrates may comprise materials with intermediate thermal diffusivity (i.e. with thermal diffusivity on the order of $10^{-5}$ $m^2/s$), and the thickness t can be selected such that $t<0.75\sqrt{(\alpha\cdot\tau_{cr})}$. In certain embodiments when such substrates are used, the thickness t can be selected to be less than 75% of the critical casting thickness of the alloy.

In other embodiments, the thickness t is less than 2 mm. In yet other embodiments, the thickness t is less than 1 mm. In yet other embodiments, the thickness t is less than 0.75 mm. In yet other embodiments, the thickness t is less than 0.5 mm. In other embodiments, the thickness t is in the range of 0.1 mm to 1 mm. In yet other embodiments, the thickness t is in the range of 0.2 mm to 0.8 mm.

In yet other embodiments, the thickness t is chosen such that the thermal relaxation time, $\tau_{th}$, is equal to or less than 50% of $\tau_{cr}$. In yet other embodiments, the thickness t is chosen such that the thermal relaxation time, $\tau_{th}$, is equal to or less than 50% of $\tau_{cr}$. In yet other embodiments, the thickness t is chosen such that the thermal relaxation time, $\tau_{th}$, is equal to or less than 25% of $\tau_{cr}$.

In certain embodiments, the temperature of the substrates is sufficiently low such that the melt is quenched by conduction to the substrates at a rate greater than the critical cooling rate required to bypass crystallization thereby enabling the melt to vitrify, i.e. to transform to the metallic glass phase. In some embodiments, the temperature of the substrates is below $T_{cr}$. In other embodiments, the temperature of the substrates is below the average between $T_g$ and $T_L$. In other embodiments, the temperature of the substrates is below $T_g$. In yet other embodiments, the temperature of the substrates is below 500° C. In yet other embodiments, the temperature of the substrates is below 400° C. In yet other embodiments, the temperature of the substrates is below 300° C. In yet other embodiments, the temperature of the substrates is below 200° C. In yet other embodiments, the temperature of the substrates is below 100° C. In yet other embodiments, the temperature of the substrates is below 50° C.

In certain embodiments, the process reaches a steady state. It should be understood that in the context of the disclosure, the term 'steady state' refers to the condition where the temperature at a given location between the substrates varies by less than 20% over 100 s. In other embodiments, the term steady state refers to the condition where the temperature at a given location between the substrates varies by less than 10% over 100 s. In yet other embodiments, the term steady state refers to the condition where the temperature at a given location between the substrates varies by less than 5% over 100 s.

Figure 5:
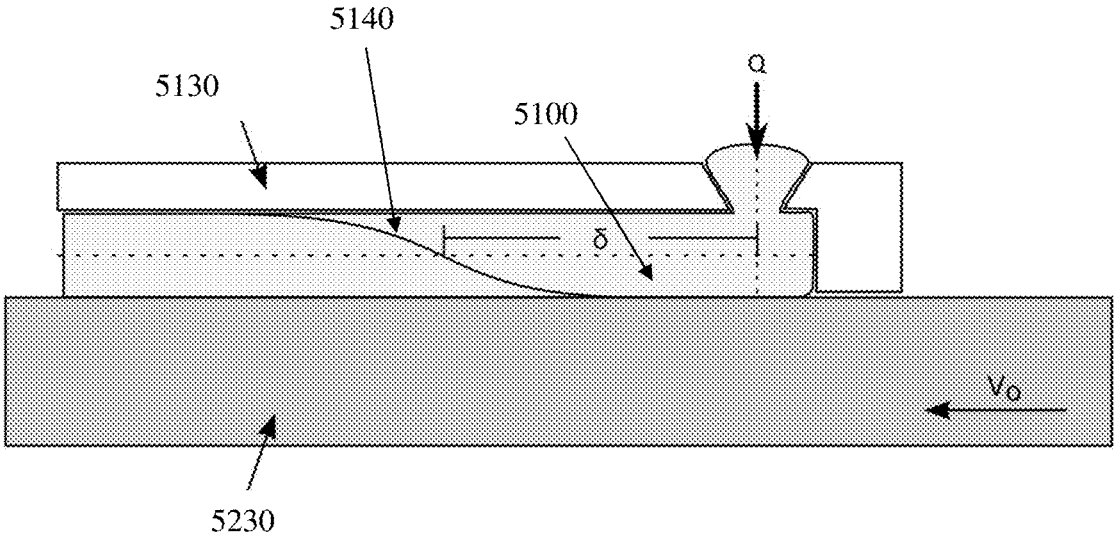
FIG. 5 provides a schematic illustrating a cross-sectional view of a melt/substrate configuration with the various thermal regions indicated.

In certain embodiments where a steady state is established, a hot pool 5100 develops downstream of the injection point that can extend a distance δ away from the injection point. This is shown schematically in FIG. 5. The hot pool 5100 is defined as the region where the alloy is still in a melt "fluid" state rather than in a frozen "viscous" state. An isothermal contour 5140 is shown in FIG. 5 representing the boundary between the melt "fluid" state and the frozen "viscous" state. In this contour, the length of the hot pool δ is defined as the distance between the injection point Q and the boundary of the hot pool halfway between the two substrates 5130 and 5230. The deposited material will spend an approximate amount of time, $\tau_h=\delta/V_o$, in the hot pool. In some embodiments, the time the material spends in the hot pool may be such that $\tau_h<\tau_{th}$.

In some embodiments, the hot pool is defined as the region where the mean temperature across t is higher than $T_{cr}$. In other embodiments, the hot pool is defined as that region where the mean temperature across t is higher than the average temperature between $T_g$ and $T_l$. In other embodiments, the hot pool is defined as that region where the mean viscosity across t is less than $10^5$ Pa-s. In yet other embodiments, the hot pool is defined as that region where the mean viscosity across t is less than $10^4$ Pa-s. In yet other embodiments, the hot pool is defined as that region where the mean viscosity across t is less than $10^3$ Pa-s. In yet other embodiments, the hot pool is defined as that region where the mean viscosity across t is less than $10^2$ Pa-s. In yet other embodiments, the hot pool is defined as the region where the mean viscosity across t is less than 10 Pa-s.

In some embodiments, the molten alloy may undergo shear flow while in the hot pool. In one embodiment, the shearing rate in the hot pool is less than the value $2t/V_o$. In another embodiment, the shearing rate in the hot pool is less than the value $t/V_o$. In another embodiment, the shearing rate in the hot pool is less than the value $0.5t/V_o$. In other embodiments, the molten alloy may undergo limited shear flow while in the chill zone. In one embodiment, the shearing rate in the chill zone is less than the value $0.2t/V_o$. In another embodiment, the shearing rate in the chill zone is less than the value $0.1t/V_o$. In another embodiment, the shearing rate in the chill zone is less than the value $0.05t/V_o$.

With respect to the absolute value of δ, in some embodiments, δ is at least 1 mm, in other embodiments at least 10 mm, in yet other embodiments at least 25 mm, in yet other embodiments at least 5 cm, in yet other embodiments at least 10 cm, in yet other embodiments at least 50 cm, while in yet other embodiments at least 1 m. The value of δ can also be defined relatively to the channel thickness t. In some embodiments δ/t is at least 1, in other embodiments at least 10, in yet other embodiments at least 25, in yet other embodiments at least 50, in yet other embodiments at least 100, in yet other embodiments at least 500, in other embodiments at least 1000, while in yet other embodiments at least 10000.

In certain embodiments, the term steady state refers to the condition where δ varies by less than 20% over 100 s. In yet other embodiments, the term steady state refers to the condition where δ varies by less than 10% over 100 s. In yet other embodiments, the term 'steady state' refers to the condition where δ varies by less than 5% over 100 s.

In embodiments of the disclosure, the relative velocity between the substrates $V_o$ is adjusted according to the choice of δ. Specifically, $V_o$ can be determined as a function of δ, as follows:

$$V_o=\delta/\tau_{th} \quad \text{Eq. (3)}$$

Substituting Eq. (2) into Eq. (3) one obtains:

$$V_o=\delta\alpha/ct^2=(1/c)\times(\delta/t)\times(\alpha/t) \quad \text{Eq. (4)}$$

In some embodiments, the substrate relative velocity $V_o$ is in the range of 0.1α/t to 10000α/t. In other embodiments, the substrate relative velocity $V_o$ is in the range of α/t to 1000α/t. In yet other embodiments, the velocity $V_o$ is in the range of 10α/t to 100α/t. In some embodiments, the substrate relative velocity $V_o$ is greater than 0.1α/t. In some embodiments, the substrate relative velocity $V_o$ is greater than α/t. In some embodiments, the substrate relative velocity $V_o$ is greater than 10α/t. In some embodiments, the substrate relative velocity $V_o$ is less than 10000α/t. In some embodiments, the substrate relative velocity $V_o$ is less than 1000α/t. In some embodiments, the substrate relative velocity $V_o$ is less than 100α/t.

In some embodiments, the substrate relative velocity $V_o$ is in the range of 0.1 mm/s to 10 m/s. In other embodiments, the velocity $V_o$ is in the range of 0.5 mm/s to 5 m/s. In yet other embodiments, the velocity $V_o$ is in the range of 1 mm/s to 1 m/s. In yet other embodiments, the velocity $V_o$ is in the range of 1 cm/s to 10 cm/s. In some embodiments, the substrate relative velocity $V_o$ is greater than 0.1 mm/s. In some embodiments, the substrate relative velocity $V_o$ is greater than 0.5 mm/s. In some embodiments, the substrate relative velocity $V_o$ is greater than 1 mm/s. In some embodiments, the substrate relative velocity $V_o$ is less than 10 mm/s. In some embodiments, the substrate relative velocity $V_o$ is less than 15 mm/s. In some embodiments, the substrate relative velocity $V_o$ is less than 1 mm/s.

In certain embodiments, the melt deposition rate Q is in the range of 0.1αw to 10000αw. In other embodiments, the melt deposition rate Q is in the range of αw to 1000αw. In yet other embodiments, the melt deposition rate Q is in the range of 10αw to 100αw. In some embodiments, the melt deposition rate Q is greater than αw. In some embodiments, the melt deposition rate Q is greater than 0.1αw. In some embodiments, the melt deposition rate Q is greater than 10αw. In some embodiments, the melt deposition rate Q is less than 10000αw. In some embodiments, the melt deposition rate Q is less than 1000αw. In some embodiments, the melt deposition rate Q is less than 100αw.

In other embodiments, the melt deposition rate Q is in the range of $10^{-10}$ $m^3/s$ to $10^{-2}$ $m^3/s$. In other embodiments, the melt deposition rate Q is in the range of be $10^{-9}$ $m^3/s$ to $10^{-3}$ $m^3/s$. In other embodiments, the melt deposition rate Q is in the range of $10^{-8}$ $m^3/s$ to $10^{-4}$ $m^3/s$. In yet other embodiments, the melt deposition rate Q is in the range of $10^{-7}$ $m^3/s$ to $10^{-5}$ $m^3/s$. In some embodiments, the melt deposition rate Q is greater than $10^{-10}$ $m^3/s$. In some embodiments, the melt deposition rate Q is greater than $10^{-9}$ $m^3/s$. In some embodiments, the melt deposition rate Q is greater than $10^{-8}$ $m^3/s$. In some embodiments, the melt deposition rate Q is greater than $10^{-7}$ $m^3/s$. In some embodiments, the melt deposition rate Q is less than $10^{-2}$ $m^3/s$. In some embodiments, the melt deposition rate Q is less than $10^{-3}$ $m^3/s$. In some embodiments, the melt deposition rate Q is less than $10^{-4}$ $m^3/s$. In some embodiments, the melt deposition rate Q is less than $10^{-5}$ $m^3/s$.

In certain embodiments where steady state is established, δ includes the region where the nozzle deposits the liquid onto the chill plate so that the liquid in the nozzle will not freeze before being deposited. In other embodiments where steady state is established, λ does not extend beyond the end of the guide plate so that the liquid remains confined while being cooled.

In some embodiments, the molten alloy may be overheated, such that the glass-forming ability of the alloy and the toughness of the metallic glass sheet or tube can be improved. In some such embodiments, the molten alloy temperature prior to being deposited is heated to a temperature of at least 300° C. higher than the alloy liquidus temperature $T_L$. In yet another embodiment, the melt temperature of the alloy prior to being deposited is heated to a temperature of at least 100° C. higher than $T_L$. In yet another embodiment, the melt temperature of the alloy prior to being deposited is heated to a temperature of at least 20° C. higher than $T_L$.

In other embodiments, at least one of the substrates has a thermal diffusivity greater than $10^{-4}$ $m^2/s$. In other embodiments, at least one of the substrates has a thermal diffusivity less than $10^{-6}$ $m^2/s$.

In yet other embodiments, at least one of the substrates comprises a metal or metal alloy. In some embodiments, at least one of the substrates comprises a metal or metal alloy selected from a group including copper, bronze, brass, steel, aluminum, and aluminum alloy, among others.

In still yet other embodiments, one of the substrates comprises a ceramic. In some embodiments, one of the substrates comprises a ceramic selected from a group including zirconia, alumina, boron nitride, and silicate glass, among others.

In still yet other embodiments, one of the substrates comprises a coating at the contact surface with the melt. In some embodiments, one of the substrates comprises a ceramic coating at the contact surface with the melt. In some embodiments, one of the substrates comprises a ceramic coating at the contact surface with the melt selected from a group including zirconia coating, alumina coating, boron nitride coating, and silicate glass coating, among others.

Apparatus Configurations

Figure 6:
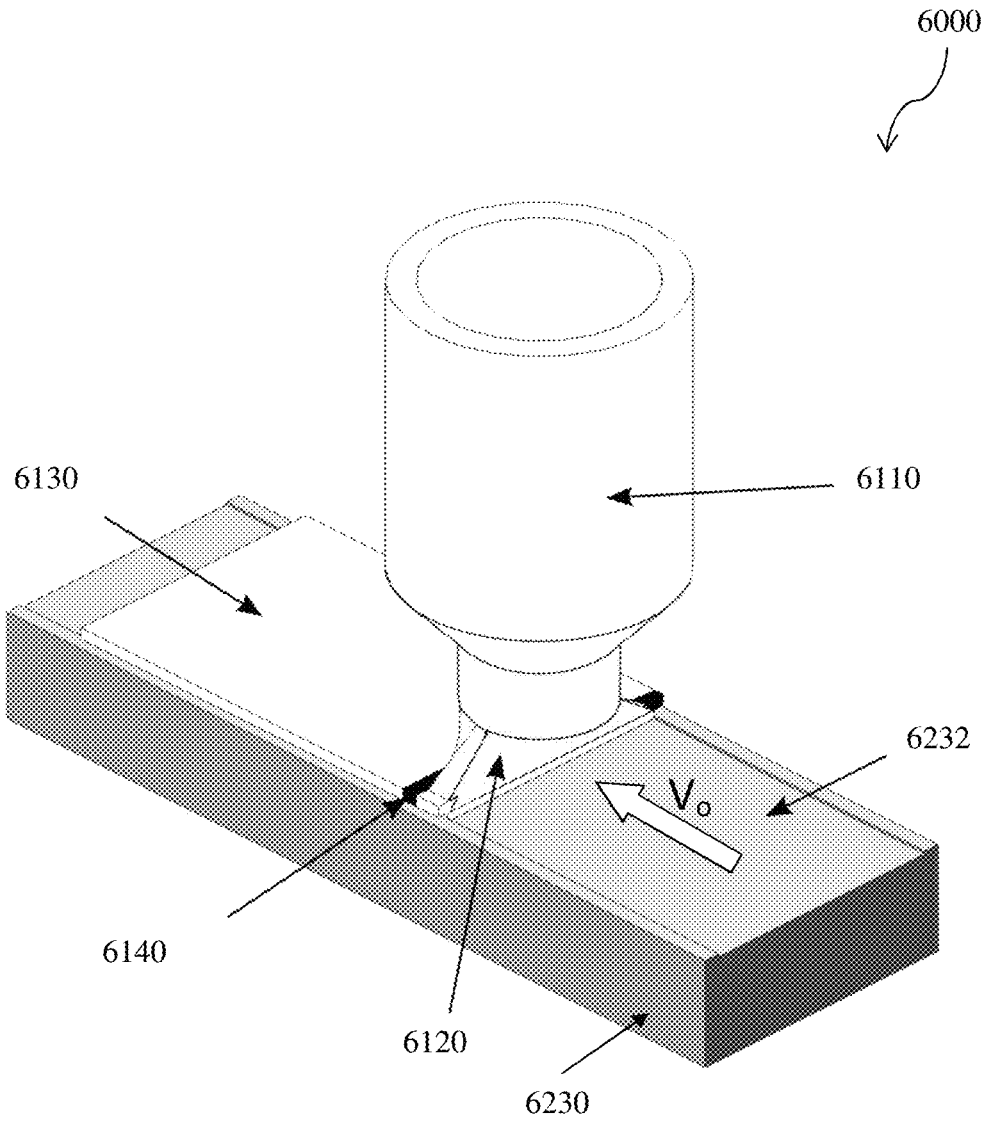
FIG. 6 provides a schematic illustrating an isometric view of an apparatus for producing metallic glass sheet in accordance with embodiments of the disclosure.
Figure 7:
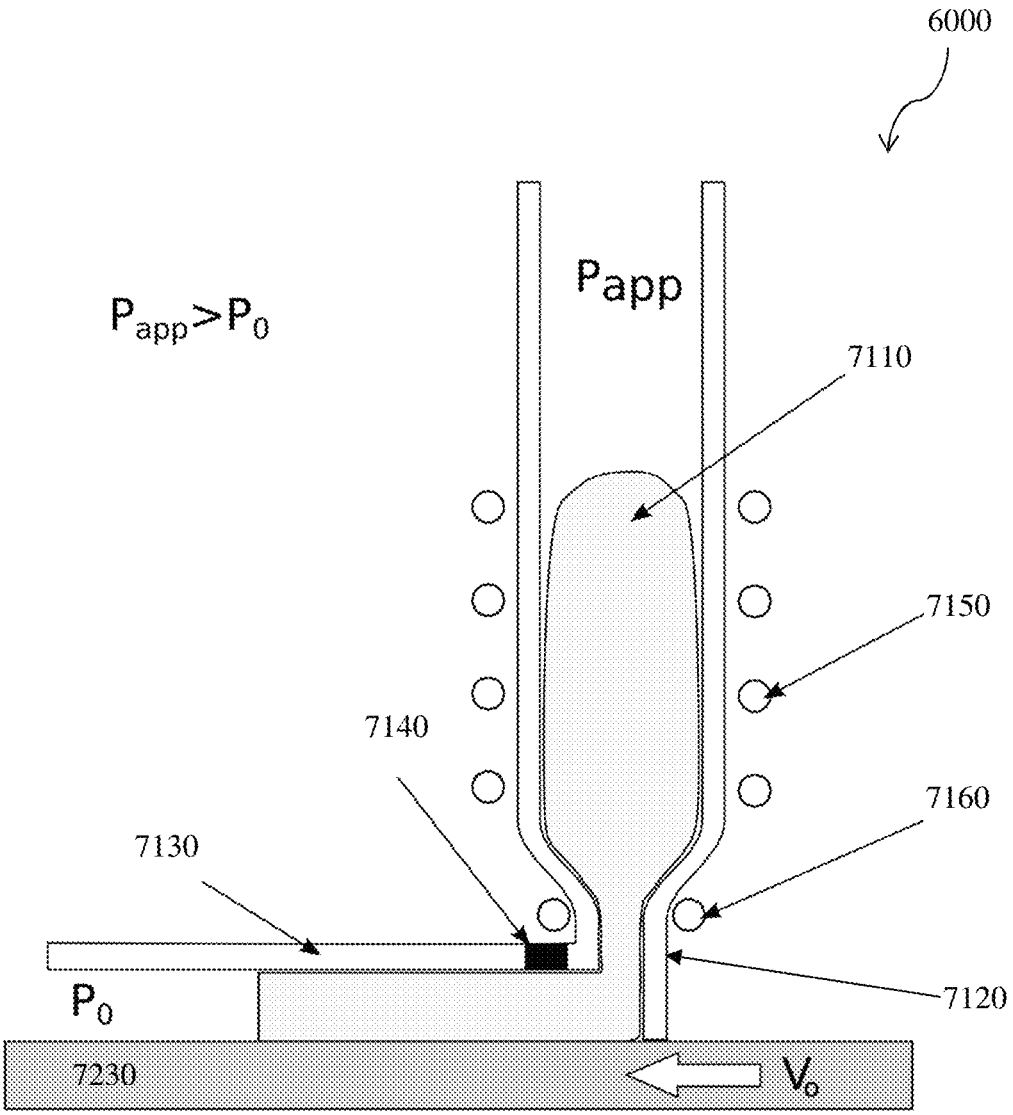
FIG. 7 provides a schematic illustrating a cross-sectional view of the apparatus of FIG. 6.

In some embodiments, as shown schematically in FIGS. 6 and 7, a metallic glass sheet may be formed using an apparatus 6000 using plate-like substrates. In such an apparatus, a flat guide substrate 6130 or 7130 of width w moves over a flat stationary chill substrate 6230 or 7230 at velocity $V_o$ with their mating surfaces in parallel separated by a gap with height or thickness t. The guide substrate 6130 or 7130 may be connected to a melt reservoir 6110 or 7110 in which the molten alloy is contained via a thin longitudinal nozzle 6120 or 7120 extending across the width w.

In some such embodiments, the guide substrate is held at a temperature lower than the temperature of the melt reservoir and nozzle. In other such embodiments, the guide substrate is held at a temperature lower than $T_{cr}$. In other such embodiments, the guide substrate is held at a temperature lower than the average between $T_g$ and $T_L$. In other such embodiments, the guide substrate is held at a temperature lower than $T_g$.

In some embodiments, the guide substrate may be in contact with a thermal reservoir held at fixed temperature within the ranges described above. The thermal reservoir may be disposed between the guide substrate and the nozzle. In some embodiments, the thermal reservoir may be a thick copper substrate held at room temperature, over a contact area that is considerably larger (i.e. at least 100 times larger, and in some embodiments 1000 times larger) than the contact area between the guide substrate and the nozzle foot. In another embodiment, the guide substrate is cooled by a flowing coolant fluid in contact with the substrate. In some embodiments the coolant fluid is water, while in other embodiments is oil. In another embodiment, the guide substrate is cooled by a flowing a coolant gas around the substrate. In some embodiments the coolant gas is helium, while in other embodiments is air.

In alternative embodiments, as illustrated in FIGS. 6 and 7, the guide substrate 6130 or 7130 is thermally isolated from the melt reservoir 6110 or 7110 and nozzle 6120 or 7120 by means of a thermal insulator 6140 or 7140. In some embodiments, the thermal insulation is a polymer or a ceramic.

In some embodiments, the guide substrate may also comprise a lip or step (not shown) along the outer edge of the nozzle on the side of relative motion of the chill substrate having a width w and a height t.

In many embodiments, as illustrated in FIG. 7, the molten alloy is heated in the melt reservoir 7110 by a heating coil 7150, and the molten alloy temperature at the nozzle 7120 is controlled by a nozzle heating coil 7160. The molten alloy may be extracted through the nozzle 7120 by applying a pressure $P_{app}$ to the molten alloy in the reservoir 7110 that is greater than the ambient pressure in the channel $P_o$ such that the molten alloy is injected through the nozzle 7120 with a small net positive applied pressure $\Delta P = P_{app} - P_o$ and at a flow rate or deposition rate Q.

In some embodiments, the chill substrate may include two parallel lips of height t separated by a distance w defining a channel of rectangular cross section having a width w and a height t over which the chill plate may be configured to slide.

In an alternative embodiment, the guide substrate may move while the chill substrate is stationary, in another embodiment the guide substrate is stationary while the chill substrate may move, yet in still other embodiments both substrates may move relative to each other.

Although the embodiment in FIGS. 6 and 7 present a flat sheet, the curvature may vary. It will be appreciated by those skilled in the art that the curvature may be elliptical or angular, or any other shape, configuration or geometry.

Figure 8:
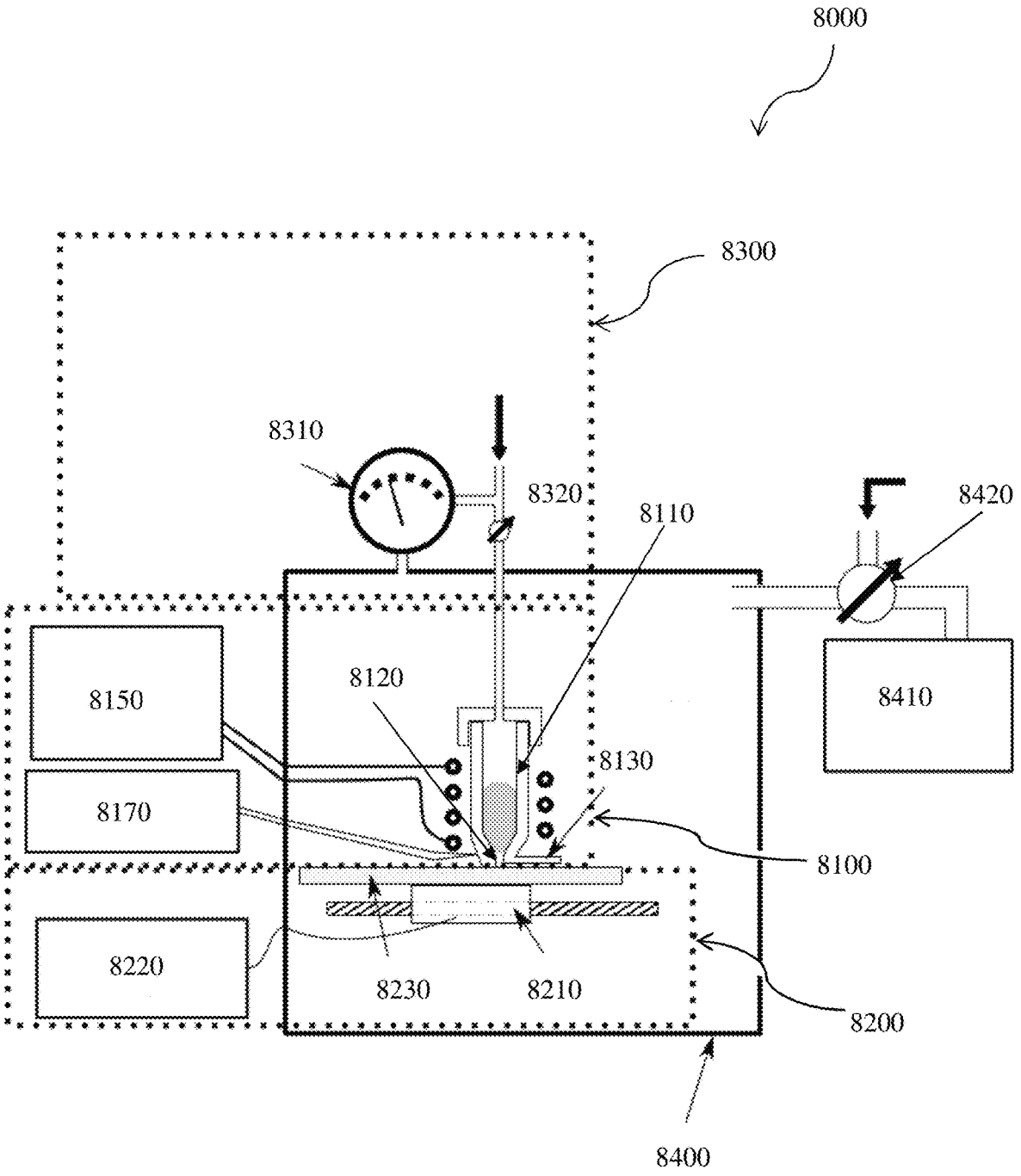
FIG. 8 provides a schematic illustrating the various components of an apparatus for producing metallic glass object by melt deposition in accordance with embodiments of the disclosure.

In some embodiments, as shown schematically in FIG. 8, an apparatus 8000 for producing a metallic glass by melt deposition may comprise three main components: (1) the crucible/nozzle system 8100, (2) the chill substrate/motion system 8200, and (3) the deposition control system 8300. In one embodiment, as shown in FIG. 8, the crucible/nozzle system 8100 comprises a crucible 8110 for containing the molten alloy, a nozzle 8120, and a guide substrate 8130. The crucible/nozzle system further comprises an induction power supply 8150 to heat the molten alloy. In some embodiments, the apparatus further comprises a thermocouple reader 8170 to monitor the temperature of the molten alloy. The chill substrate/motion system 8200 comprises a chill substrate 8230, at least one actuator 8210 to provide relative motion between substrates 8130 and 8230, and an actuator control system 8220. The deposition control system 8300 comprises a gas pressure/flow controller 8310 and a pressure/gas control valve 8320.

In certain embodiments, an apparatus for producing a metallic glass by melt deposition may also comprise an environmental chamber 8400 for atmosphere control. As shown, the environmental chamber 8400 is configured to house the crucible/nozzle system 8100 and the chill substrate/motion system 8200. Apparatus 8000 further comprises a vacuum pump 8410 and a valve 8420 in fluid communication with environmental chamber 8400. In other embodiments, the vacuum pump may also be disposed to be housed within the environmental chamber.

The Crucible/Nozzle System:

In some embodiments, the crucible, which contains the molten alloy, may comprise a material that does not chemically react with the molten alloy and remains stable at the temperatures at which the molten alloy will be held. In the context of this disclosure, "chemical reaction" of the crucible with the molten alloy (i.e. the dissolution of a portion of the crucible in the molten alloy during the melt deposition process) is negligible. In some embodiments the chemical reaction of the crucible with the molten alloy is at concentrations of less than 500 ppm (parts per million), and in some embodiments less than 100 ppm, while in other embodiments less than 50 ppm. The crucible remains stable at the temperatures at which the molten alloy will be held. In the context of this disclosure, to remain stable the crucible does not chemically decompose or lose its shape or mechanical integrity.

The crucible can be formed from a variety of materials that remain stable at the temperatures at which the molten alloy will be held. For example, in one embodiment, the crucible can comprise fused silica glass. In another embodiment, the crucible can comprise a ceramic such as alumina of zirconia. In yet another embodiment, the crucible can comprise graphite. In yet another embodiment, the crucible can comprise sintered crystalline silica.

The nozzle may be shaped to extract and deposit the molten alloy in a controlled manner while allowing the molten alloy to be deposited evenly and continuously in the channel between the two substrates. In one embodiment, as shown schematically in FIGS. 6 and 7, the nozzle is integrally formed as the tapered base of the crucible with an orifice configured to allow for flow of molten alloy onto the chill substrate. In alternative embodiments, a step (not shown) may be attached on the bottom part of the nozzle, or formed as an integral part of the nozzle, to prevent the molten alloy from flowing in a direction opposite to the relative motion of the guide substrate and chill substrate. In other alternative embodiments, the nozzle may be removably affixed to the crucible.

In certain embodiments, as the liquid is deposited under a small net positive applied pressure $\Delta P$, it may be confined to prevent unwanted shear flow. In some embodiments, gaps may exist between some of the apparatus components. A "step gap" is shown in FIG. 6 between the step and the chill substrate. The thickness of the gaps may be limited so that the liquid does not flow out of the confined area. In one embodiment, a gap has thickness less than 20% of t. In another embodiment, a gap has thickness less than 10% of t. In yet one embodiment, a gap has thickness less than 5% of t.

In certain embodiments, the molten alloy may be heated inductively. In such an embodiment, the nozzle may comprise a material that is susceptible to inductive heating, such as graphite. A nozzle comprising a material capable of inductive heating allows for finer control of the melt temperature at the nozzle orifice.

The Chill Substrate/Motion System:

The chill substrate/motion system 8200 comprises the chill substrate 8230, at least one actuator 8210 and an actuator control system 8220, as shown in FIG. 8. The molten alloy is deposited upon the chill substrate 8230. The actuator (or actuators) 8210 provides the relative motion between the chill substrate 8230 and the nozzle/guide substrate 8120 and 8130. The actuator system 8220 controls the actuator (or actuators) 8210.

A variety of actuator types are suitable for use to provide the relative motion. In some embodiments, the actuators may be selected from, for example, electric, mechanical, pneumatic, and hydraulic. Electrical actuators may be selected from, for example, linear magnetic motors, stepper motors, and servomotors.

In the various embodiments, as shown schematically in FIG. 6, the chill substrate 6230 comprises a groove to act as the channel 6232 into which the molten alloy is deposited.

The Deposition Control System:

In some embodiments, the deposition control system controls the rate at which the molten alloy is extracted through the nozzle. A constant melt deposition rate through the nozzle orifice may be achieved by controlling either the flow rate or the pressure. For example, the molten alloy may be extracted through the nozzle by applying a small net positive pressure $\Delta P$, where a pressure $P_{app}$ is applied to the molten alloy in the crucible that is slightly greater than the ambient pressure in the channel $P_o$.

The pressure $P_{app}$ can be controlled by introducing an inert gas, such as argon of helium. In some embodiments, as shown schematically in FIG. 8, the deposition control system 8300 may comprise a gas pressure/flow controller 8310 and a pressure/gas control valve 8320 as means to achieve substantially constant deposition rate. The inert gas may be introduced into the apparatus through the pressure/gas control valve 8320. As illustrated in FIG. 8, the gas pressure/flow controller 8310 and the pressure/gas control valve 8320 are disposed upstream of the crucible/nozzle system 8100. In some embodiments, the pressure/gas control valve may be a one-way valve for introducing gas into the crucible/nozzle system to control the pressure $P_{app}$. In other embodiments, the pressure/gas control valve may be a check valve.

A constant deposition rate may also be achieved by controlling the differential pressure between the atmosphere inside the crucible and the atmosphere outside of the crucible by use of the gas pressure/flow controller 8310 and the pressure/gas control valve 8320. For example, a constant deposition rate may be achieved by controlling the flow rate of the gas into the crucible through the gas pressure/flow controller 8310.

In other embodiments, a constant flow of the molten alloy through the nozzle orifice that results in a constant deposition rate may be achieved by means of a mechanical actuator operating at controlled displacement rate. In some embodiments the actuator may be pneumatic, hydraulic, magnetic, or electrical. In some embodiments, the controlled displacement rate is achieved by means a plunger drive of cross sectional area $A_p$ moving inside a housing section of the crucible (i.e. the shot sleeve) at a controlled velocity $V_p$. In some embodiments, $V_p$ is constant. In some embodiments, $V_p$ is equal to the value $(V_o \times r \times w)/A_p$. In other embodiments, $V_p$ is within 50% of the value $(V_o \times r \times w)/A_p$. In other embodiments, $V_p$ is within 20% of the value $(V_o \times r \times w)/A_p$. In other embodiments, $V_p$ is within 10% of the value $(V_o \times r \times w)/A_p$. In other embodiments, $V_p$ is within 5% of the value $(V_o \times t \times w)/A_p$.

Environmental Chamber:

In some embodiments, as illustrated in FIG. 8, an apparatus 8000 for producing a metallic glass by melt deposition may further include an environmental chamber 8400 used for atmosphere control. In some embodiments, both the crucible/nozzle system 8100 and the chill substrate/motion system 8200 may be disposed inside the environmental chamber. In other embodiments, the crucible/nozzle system may be disposed inside the environmental chamber. In still other embodiments, the chill substrate/motion system may be disposed inside the environmental chamber. In yet other embodiments, the deposition control system 8300 may also be disposed inside the environmental chamber.

The molten alloy may be extracted through the nozzle 8120 by applying a small net positive pressure ΔP, where a pressure $P_{app}$ is applied to the molten alloy in the crucible 8110 that is slightly greater than the ambient pressure in the channel $P_o$. The environmental chamber 8400 may be used to maintain the ambient pressure, $P_o$, of the process and provide an atmosphere that is inert in the presence of the molten alloy. The environmental chamber 8400 may be a vacuum chamber. As illustrated in FIG. 8, in some embodiments, a vacuum pump 8410 is configured to be in fluid communication with the environmental chamber 8400. Valve 8420 is disposed to be fluidly between the vacuum pump 8410 and environmental chamber 8400. Vacuum pump 8410 can be used to control the differential pressure between the atmosphere inside the crucible 8110 and the atmosphere in channel such that the pressure in the channel $P_o$ is less than the pressure $P_{app}$ in the crucible 8110.

In some embodiments, the environmental chamber 8400 may be a vacuum chamber so that the inert gas pressure, $P_o$, can range between vacuum (typically 0.1 Pa) and 1 atmosphere. In other embodiments, the environmental chamber 8400 may be a vacuum/pressure chamber so that the inert gas pressure, $P_o$, can range between a vacuum and pressures larger than 1 atmosphere. In some embodiments, the chamber frame comprises a metal such as steel or aluminum. In other embodiments, the chamber may include a window made of a transparent material, such as plexiglas, to enable visualization of the process. In yet other embodiments, the chamber includes a glove box to enable access to the apparatus without the need for evacuating the chamber.

Figure 9:
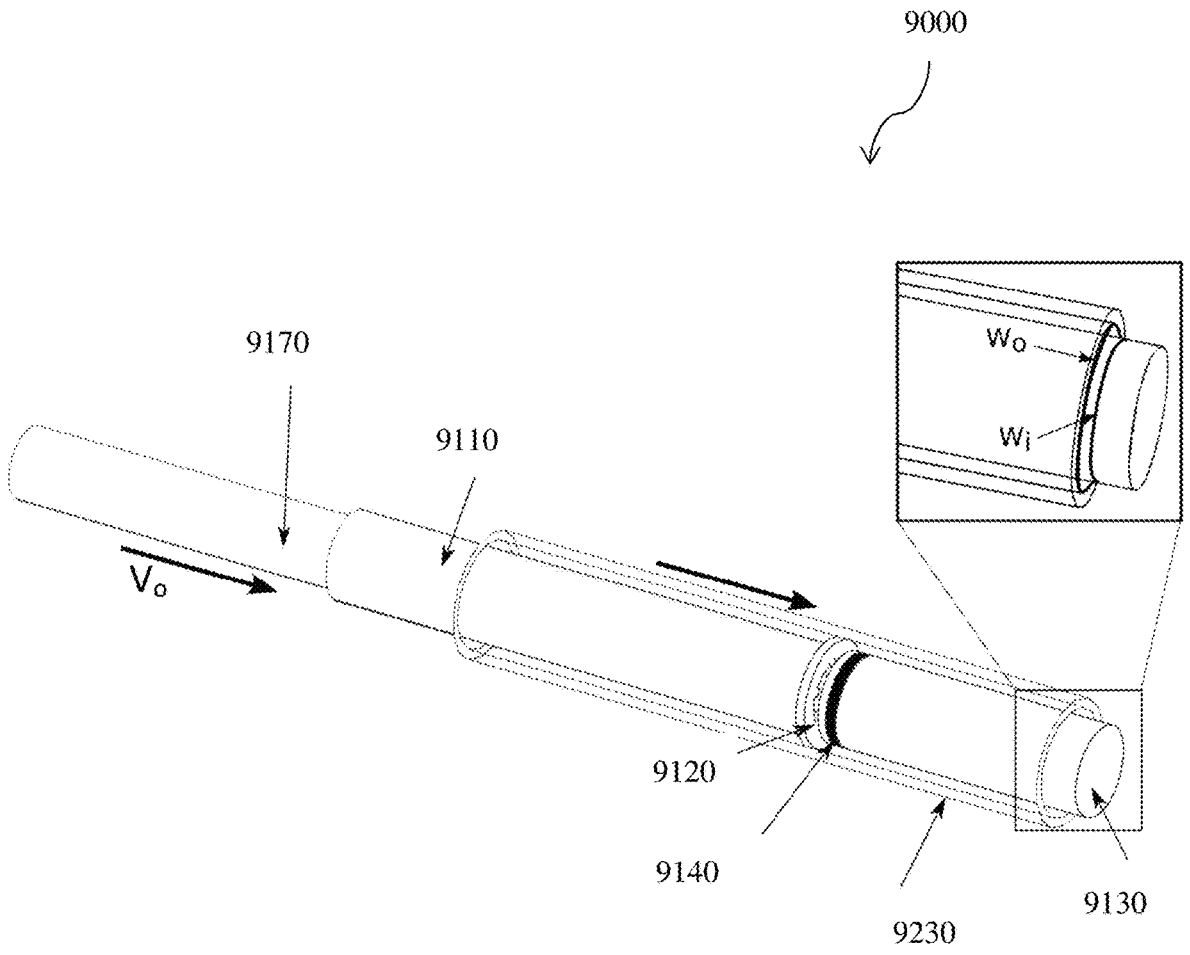
FIG. 9 provides a schematic illustrating an isometric view of an apparatus for producing metallic glass tube in accordance with embodiments of the disclosure.
Figure 10:
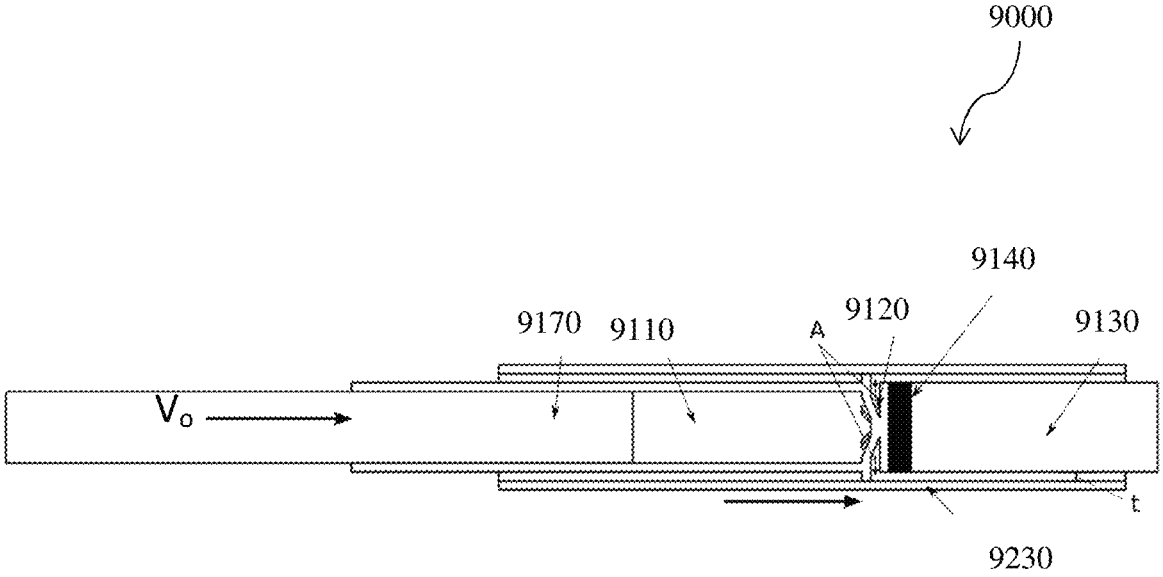
FIG. 10 provides a schematic illustrating a cross-sectional view of the apparatus of FIG. 9.
Figure 11:
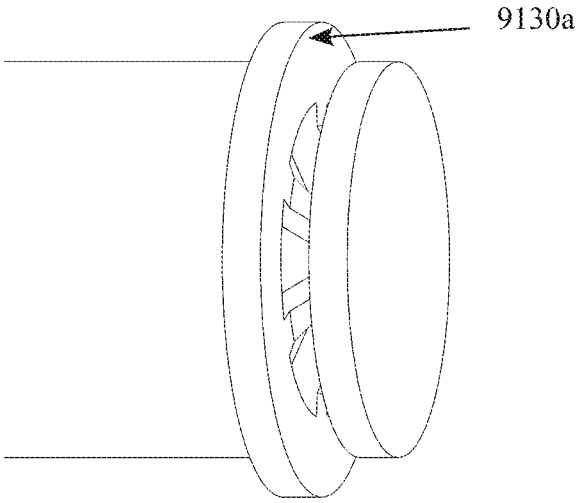
FIG. 11 provides a schematic illustrating an isometric view of the nozzle in the apparatus of FIG. 9.

In another embodiment, as depicted in FIGS. 9 to 11, a metallic glass tube may be formed using an apparatus 9000 using tubular-shaped substrates. As illustrated in FIGS. 9 and 10, in some such embodiments, a cylindrical chill tube 9230 of internal circumference $w_o$ acting as the exterior substrate moves concentrically over a stationary guide tube 9130 of exterior circumference $w_i$ acting as the interior substrate at velocity $V_o$ such that a cylindrical tube-shape gap with thickness t is formed. In such embodiments, the guide tube may be attached to a nozzle 9120 coupled to a melt reservoir 9110. The guide tube 9130 is held at a temperature lower than the temperature of the melt reservoir and nozzle. In some embodiments, the guide tube 9130 may be thermally isolated from the melt reservoir 9110 and nozzle 9120 by means of a thermal insulator 9140. In some embodiments, the melt reservoir 9110 has a cylindrical tube shape that is concentrically placed within the chill tube 9230. Likewise, in some such embodiments, the nozzle 9120 has a cylindrical shape configured to radially inject the molten alloy in the melt reservoir 9110 outwards from the guide tube towards the inner surface of the chill tube, as shown by arrows A. During operation, the nozzle 9120 is placed between the guide tube and the melt reservoir. In some embodiments, as depicted in the detailed view of FIG. 11, the guide tube may also comprise a lip 9130*a* along the outer edge of the nozzle on the side of motion having width w and height t.

The molten alloy may be extracted through the nozzle by applying a small net positive pressure ΔP, where a pressure $P_{app}$ is applied by a plunger 9170 to the molten alloy in the reservoir that is slightly greater than the ambient pressure in the gap $P_o$ such that the molten alloy is injected through the nozzle with a net positive pressure $P_{app}-P_o$ and at a substantially constant flow rate or deposition rate Q.

In an alternative embodiment, the guide tube is moving while the chill tube is stationary, and in still other embodiments both the guide tube and chill tube are moving relative to each other.

Although the exemplary apparatus depicted in FIGS. 9-11 presents a cylindrical tube, the cross-section may vary. It will be appreciated by those skilled in the art that the cross-section may be circular, elliptical, square, or any other shape, configuration or geometry.

In some embodiments, the melt reservoir may be designed to undergo vibrational agitation. In certain embodiments the vibrational agitation is normal to the chill substrate, while in other embodiments is parallel to the chill substrate. Vibrational agitation may be used to overcome capillary effects which can lead to the break-up of the melt front. Likewise, vibrational agitation may help the molten alloy to contact the chill substrate and any "edges" in a mold cavity within the chill substrate. Vibrational agitation may also be useful in obtaining a high quality product sheet with precise edges or a tube.

It should be understood that the disclosed process can be achieved by any suitable deposition mechanism. In some embodiments, the molten alloy is deposited by applying a pressure to the molten alloy in a melt reservoir. In some embodiments, the pressure is pneumatic, i.e. is applied by gas pressure. In other embodiments, the pressure is mechanical, i.e. is applied by a plunger driven by a hydraulic or magnetic drive. The applied pressure is greater than the pressure in the gap or channel between the two substrates. In this embodiment, a net force would be exerted by the molten alloy against the substrates such that the molten alloy surface would be in continuous contact with the substrates to facilitate heat transfer from the molten alloy to the substrate (s) to quench the molten alloy, and to ensure good surface characteristics of the sheet or tube (where substrate features with length scales of 10 micrometers or less are replicated).

EXAMPLES

The following examples illustrate various aspects of the disclosure. It will be apparent to those skilled in the art that many modifications, both to materials and methods, may be practiced without departing from the scope of the disclosure.

Example 1

The materials used for the substrates can also affect the disclosed process. In particular, the thermal diffusivity of the substrates in comparison to the metallic glass may influence the velocity $V_o$ and deposition rate Q for a given thickness.

For example, in some embodiments, the two substrates may have a thermal diffusivity much higher than the metallic glass (e.g. in some embodiments by at least a factor of 5, while in other embodiments by at least a factor of 10), such that their thermal diffusivity can be assumed to be approximately infinite. For example, copper has thermal diffusivity of about $1\times10^{-4}$ $m^2/s$, and can be considered approximately infinite when compared to the thermal diffusivity of the metallic glass, which is typically on the order of $1\times10^{-6}$ $m^2/s$. When both substrates have approximately infinite thermal diffusivity, the thermal relaxation time $\tau_{th}$ is determined by the equation:

$$\tau_{th}=t^2/\alpha \quad \text{Eq. (5)}$$

where $\alpha$ is the thermal diffusivity of the molten alloy. Therefore, according to Eq. (3), the velocity $V_o$ can be obtained as:

$$V_o=(\delta/t)\times(\alpha/t) \quad \text{Eq. (6)}$$

and according to Eq. (1), the deposition rate $Q$ is obtained as:

$$Q=(\delta/t)\times(\alpha w) \quad \text{Eq. (7)}$$

The thickness t can hence be chosen such that the thermal relaxation time, $\tau_{th}$, does not exceed the minimum time required for the molten alloy to crystallize in the undercooled state, $\tau_{cr}$, according to Eq. 8 below:

$$t<\sqrt{(\alpha\cdot\tau_{cr})} \quad \text{Eq. (8)}$$

The thermal diffusivities for the alloys capable of forming metallic glasses are on the order of $\alpha$ $1\times10^{-6}$ $m^2/s$. Considering an example metallic glass having $\tau_{cr}$=1 s, then t<1 mm according to Eq. (8). To produce a metallic glass sheet or tube with w=10 cm and t=1 mm, one can obtain $V_o$=10 mm/s, and Q=$1\times10^{-6}$ $m^3/s$ for a choice of $\delta/t$=10, $V_o$=10 cm/s, and Q=$1\times10^{-5}$ $m^3/s$ for a choice of $\delta/t$=100, and $V_o$=1 m/s, and Q=$1\times10^{-4}$ $m^3/s$ for a choice of $\delta/t$=1000, according to Eqs. (6) and (7).

One skilled in the art will recognize that other parameter values may be incorporated into the above analysis to determine appropriate process and apparatus operating conditions tailored to the needs of the particular application.

Example 2

In other embodiments, one of the two substrates has a thermal diffusivity much higher than the alloy, such that its thermal diffusivity can be assumed to be approximately infinite, while the other substrate has a thermal diffusivity much lower than the alloy (e.g. in some embodiments by at least a factor of 2, while in other embodiments by at least a factor of 5), such that its thermal diffusivity can be assumed to be approximately zero. For example, one of the two substrates may be made of copper, which is considered to have near-infinite thermal diffusivity compared to the alloy, while the other substrate may be made of a silicate glass that typically has thermal diffusivity on the order of $10^{-7}$ $m^2/s$, and can be considered to be approximately zero compared to the alloy. When one substrate has approximately infinite thermal diffusivity and the other substrate has approximately zero thermal diffusivity, the thermal relaxation time is determined by the equation:

$$\tau_{th}=4t^2/\alpha \quad \text{Eq. (9)}$$

where $\alpha$ is the thermal diffusivity of the molten alloy capable of forming metallic glass. Therefore, according to Eqs. (2) and (7), the velocity $V_o$ between the two substrates can be obtained by the following equation:

$$V_o=(1/4)\times(\delta/t)\times(\alpha/t) \quad \text{Eq. (10)}$$

and according to Eqs. (1) and (8) the deposition rate $Q$ can be obtained as:

$$Q=(1/4)\times(\delta/t)\times(\alpha w) \quad \text{Eq. (11)}$$

The thickness t can hence be chosen such that the thermal relaxation time does not exceed the minimum time required for the molten alloy to crystallize in the undercooled state according to Eq. 10 below:

$$t<0.5\sqrt{(\alpha\cdot\tau_{cr})} \quad \text{Eq. (12).}$$

Considering an example metallic glass with a thermal diffusivity on the order of $\alpha$ $1\times10^{-6}$ $m^2/s$ having $\tau_{cr}$=1 s, then t<0.5 mm according to Eq. (12). To produce a metallic glass sheet or tube with w=10 cm and t=0.5 mm, one can obtain $V_o$=5 mm/s, and Q=$0.25\times10^{-6}$ $m^3/s$ for a choice of $\delta/t$=10, $V_o$=5 cm/s, and Q=$0.25\times10^{-5}$ $m^3/s$ for a choice of $\delta/t$=100, and $V_o$=0.5 m/s, and Q=$0.25\times10^{-4}$ $m^3/s$ for a choice of $\delta/t$=1000, according to Eqs. (10) and (11) for the embodiment where one substrate has infinite thermal diffusivity and the other substrate has near-zero thermal diffusivity.

One skilled in the art will recognize that other parameter values may be incorporated into the above analysis to determine appropriate process and apparatus operating conditions tailored to the needs of the particular application.

Example 3

In another embodiment, the thermal diffusivity of the substrates is neither much higher than that of the molten alloy, nor much lower (i.e. neither infinite, nor zero). For example, this would be satisfied if both substrates have thermal diffusivities lower than copper but higher than silicate glasses, or on the order of the thermal diffusivity of the molten alloy. In this embodiment, the velocity $V_o$ and deposition rate Q can be obtained by Eqs. (13) and (14) respectively:

$$(1/4)\times(\delta/t)\times(\alpha/t)<V_o<(\delta/t)\times(\alpha/t) \quad \text{Eq. (13)}$$

$$(1/4)\times(\delta/t)\times(\alpha w)<Q<(\delta/t)\times(\alpha w) \quad \text{Eq. (14)}$$

The thickness t can be obtained by Eq. (15) as follows:

$$t<0.75\sqrt{(\alpha\cdot\tau_{cr})} \quad \text{Eq. (15)}$$

Considering an example metallic glass with a thermal diffusivity on the order of $\alpha\approx1\times10^{-6}$ $m^2/s$ having $\tau_{cr}$=1 s, then t<0.75 mm according to Eq. (15) for the embodiment where the thermal diffusivity of the substrates is neither infinite nor zero. To produce a metallic glass sheet or tube with w=10 cm and 0.5 mm<t<1 mm, one can obtain 5 mm/s<$V_o$<10 mm/s, and 0.25 $m^3/s$<Q<$1\times10^{-6}$ $m^3/s$ for a choice of $\delta/t$=10, 5 cm/s<$V_o$<10 cm/s, and $0.25\times10^{-5}$ $m^3/s$<Q<$1\times10^{-5}$ $m^3/s$ for a choice of $\delta/t$=100, and 0.5 m/s<$V_o$<1 m/s, and $0.25\times10^{-4}$ $m^3/s$<Q<$1\times10^{-4}$ $m^3/s$ for a choice of $\delta/t$=1000, according to Eqs. (6) and (7).

Example 4

A method and an apparatus in accordance with embodiments of the disclosure were used to produce metallic glass strips of different alloy compositions by melt deposition.

An apparatus according to the embodiment illustrated in FIG. 6 was used. The apparatus was enclosed within an environmental steel chamber. A quartz crucible was used as melt reservoir, with the nozzle comprised of the tapered base of the quartz crucible. The nozzle had a rectangular orifice about 0.6 mm wide and 5.5 mm long. Planar guide and chill substrates were used. The chill substrate was made of copper. The guide substrate was made of fused silica coated with a boron nitride coating on the side contacting the deposited material. The boron nitride coating was applied to the fused silica substrate by spraying a suspension of boron nitride particles and subsequently curing the particles at 200° F. A channel was formed as a groove in the chill substrate, having width w=6.3 mm and thickness t=2.0 mm. The apparatus included a stepper motor to provide the differential motion between the chill substrate and the nozzle/guide substrate.

In the example, the alloy was heated in the crucible by an induction coil. The molten alloy was extracted through the nozzle by applying gas (argon) pressure inside the crucible. The application of gas pressure was controlled by controlling the differential pressure between the atmosphere inside the crucible and the atmosphere outside of the crucible.

Figure 12:
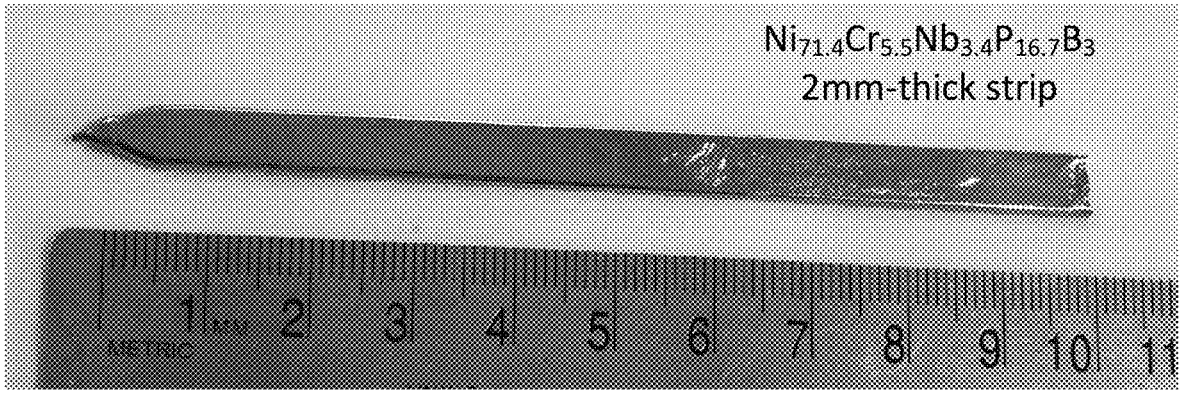
FIG. 12 provides a photograph of a 2 mm-thick strip having composition $Ni_{71.4}Cr_{5.5}Nb_{3.4}P_{16.7}B_3$ produced according to embodiments of the disclosure.
Figure 13:
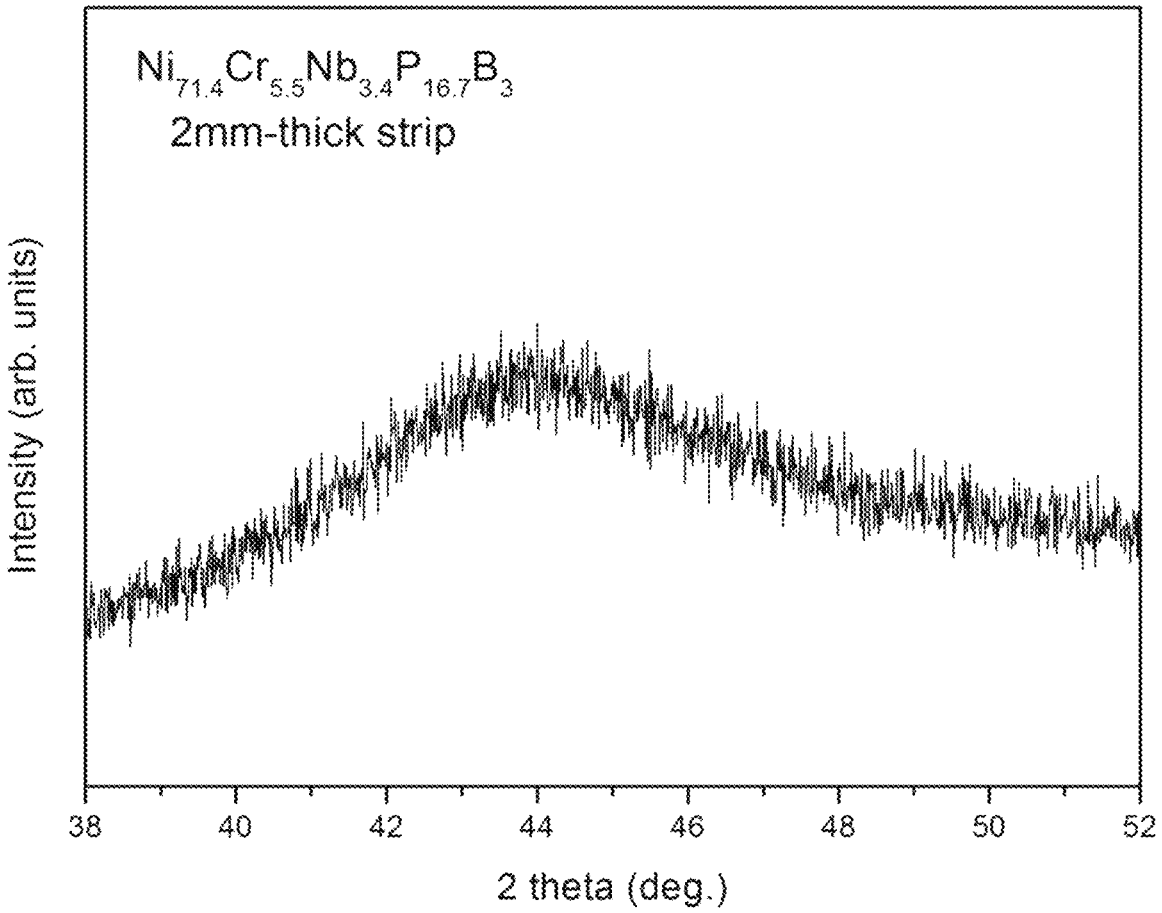
FIG. 13 provides an x-ray diffractogram verifying the amorphous structure of the cross section of the strip of FIG. 12.
Figure 14:
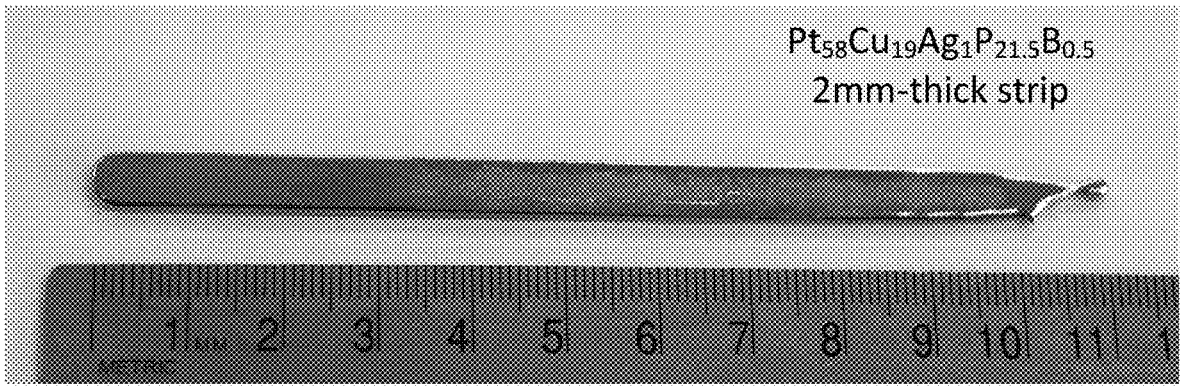
FIG. 14 provides a photograph of a 2 mm-thick $Pt_{58}Cu_{19}Ag_1P_{21.5}B_{0.5}$ strip having composition $Pt_{58}Cu_{19}Ag_1P_{21.5}B_{0.5}$ produced according to embodiments of the disclosure.

In a specific experiment, a metallic glass-forming alloy having composition $Ni_{71.4}Cr_{5.5}Nb_{3.4}P_{16.7}B_3$ was used. The chamber was evacuated to a pressure of about 1 Pa prior to backfilling with argon to a pressure of 1 atm. The molten alloy was heated to about 1000° C., and extracted from the nozzle by applying a differential argon gas pressure of about 6 kPa. The relative velocity V between the chill substrate and the nozzle/guide substrate was 140 mm/s. The entirety of the material contained in the crucible was deposited between the two substrates producing an 11-cm long metallic glass strip having thickness t=2.0 mm and width w=6.3 mm. A photograph of the strip is presented in FIG. 12. X-ray diffractograms verifying the amorphous structure of the strip cross section are presented in FIG. 14.

Figure 15:
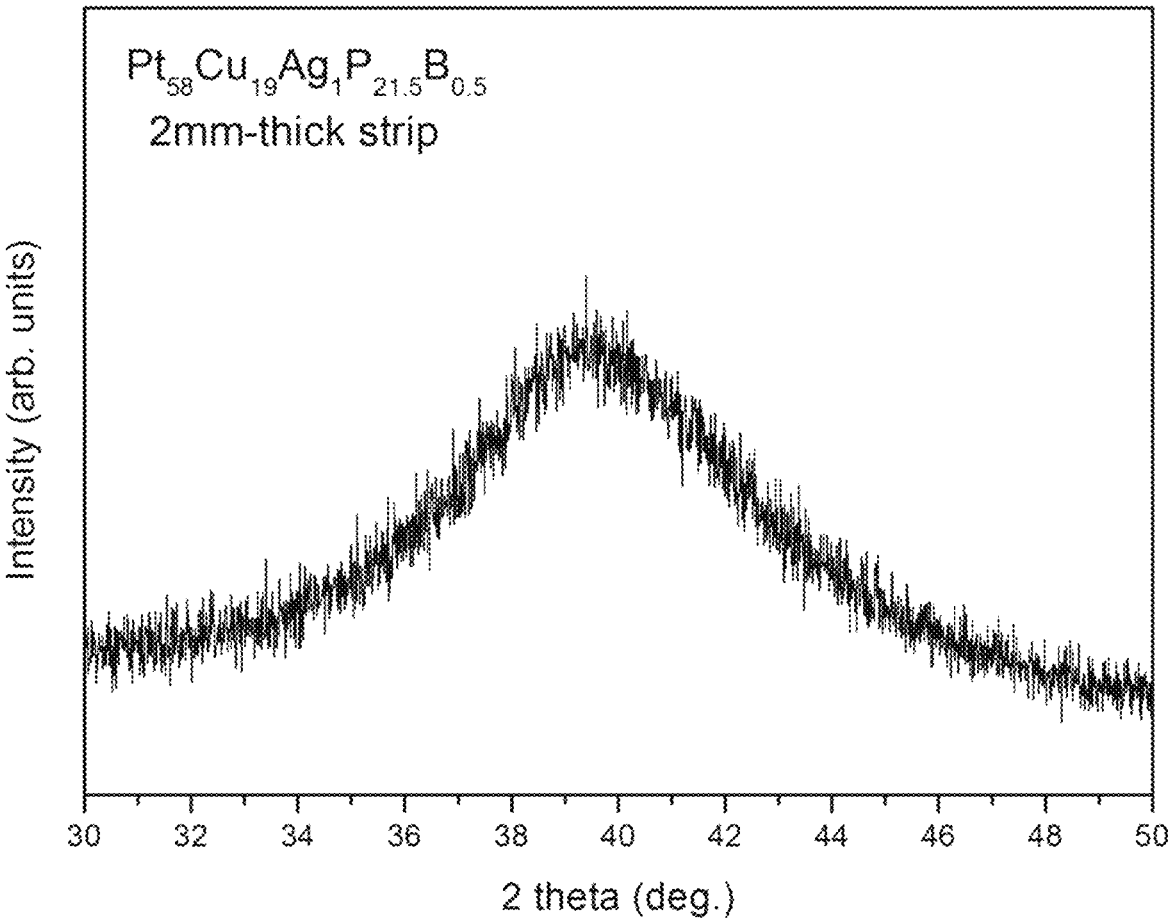
FIG. 15 provides an x-ray diffractogram verifying the amorphous structure of the cross section of the strip of FIG. 14.

In a specific experiment, a metallic glass-forming alloy having composition $Pt_{58}Cu_{19}Ag_1P_{21.5}B_{0.5}$ was used. The chamber was evacuated to a pressure of about 1 Pa prior to backfilling with argon to a pressure of 1 atm. The molten alloy was heated to about 800° C., and extracted from the nozzle by applying a differential argon gas pressure of about 6 kPa. The relative velocity V between the chill substrate and the nozzle/guide substrate was 140 mm/s. The entirety of the material contained in the crucible was deposited between the two substrates producing an 11-cm long metallic glass strip having thickness t=2.0 mm and width w=6.3 mm. A photograph of the strip is presented in FIG. 14. X-ray diffractograms verifying the amorphous structure of the strip cross section are presented in FIG. 15.

One skilled in the art will recognize that other parameter values may be incorporated into the above analysis to determine appropriate process and apparatus operating conditions tailored to the needs of the particular application.

The methods and apparatus herein can be valuable in the fabrication of electronic devices using bulk metallic glass objects. In various embodiments, the metallic glass may be used as housings or other parts of an electronic device, such as, for example, a part of the housing or casing of the device. Devices can include any consumer electronic device, such as mobile phones, watches, desktop computers, laptop computers, and/or portable music players. The device can be a part of a display, such as a digital display, a monitor, an electronic-book reader, a portable web-browser, and a computer monitor. The device can also be an entertainment device, including a portable DVD player, DVD player, Blue-Ray disk player, video game console, music player, such as a portable music player. The device can also be a part of a device that provides control, such as controlling the streaming of images, videos, sounds, or it can be a remote control for an electronic device. The alloys can be part of a computer or its accessories, such as the hard driver tower housing or casing, laptop housing, laptop keyboard, laptop track pad, desktop keyboard, mouse, and speaker. The metallic glass can also be applied to a device such as a watch or a clock.

Having described several embodiments, it will be recognized by those skilled in the art that various modifications, alternative constructions, and equivalents may be used without departing from the spirit of the disclosure. Additionally, a number of well-known processes and elements have not been described in order to avoid unnecessarily obscuring the disclosure. Accordingly, the above description should not be taken as limiting the scope of the disclosure.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

The invention claimed is:

1. An apparatus for forming a metallic glass object, the apparatus comprising:

a first substrate; and a second substrate separated from the first substrate by a gap of thickness t, the first substrate and the second substrate configured to move relative to each other at a velocity $V_o$;

the first substrate and the second substrate and the gap configured to form a channel having a thickness t and width w defined by an overlapping cross section of the first substrate and the second substrate perpendicular to a direction of the velocity $V_o$;

a melt reservoir configured to contain a molten alloy capable of forming the metallic glass object;

a nozzle configured to be in fluid communication with the melt reservoir and configured to extract the molten alloy along the overlapping cross section of the first substrate and second substrate and deposit the molten alloy at a constant deposition rate into the channel at a contact temperature with each substrate;

wherein the first substrate has a thermal conductivity of at least 10 W/m-K, wherein the second substrate has at least one of the following: a contact angle with the molten alloy capable of forming the metallic glass object of more than 90° at a contact temperature, and a surface roughness in a contact surface with a melt having an average surface asperity height of less than 1 μm;

and/or at least one of the first substrate and the second substrate is configured to cool the molten alloy.

2. The apparatus of claim 1, wherein the first substrate and the second substrate have a plate shape.

3. The apparatus of claim 1, wherein the thickness t does not vary by more than 10% at any two locations along the gap.

4. The apparatus of claim 1, wherein the constant deposition rate is achieved by means of an actuator, wherein the actuator comprises a plunger drive having cross sectional area $A_p$ moving at a velocity $V_p$, wherein $V_p$ is within 50% of the value $(V_o \times r \times w)/A_p$.

5. The apparatus of claim 1, wherein the first substrate is disposed along an outer edge of the nozzle.

6. The apparatus of claim 1, wherein the first substrate is thermally isolated from the nozzle.

7. The apparatus of claim 1, wherein the first substrate is configured to be held at a temperature lower than the temperature of the nozzle.

8. An apparatus for forming a metallic glass tube, the apparatus comprising:

an interior tubular substrate of circumference $w_i$; and an exterior tubular substrate of circumference $w_o$, where $w_o > w_i$;

the interior tubular substrate and the exterior tubular substrate are arranged concentrically with the interior substrate inside the exterior substrate such that they are separated by gap t; and the interior tubular substrate and the exterior tubular substrate are configured to move relative to each other at a velocity $V_o$;

a melt reservoir configured to contain a molten alloy and disposed in fluid communication with the gap;

where the gap is a tubular channel for a molten alloy capable of forming metallic glass to be deposited after being extracted along either $w_o$ or $w_i$ and deposited at a constant deposition rate between the interior tubular and exterior tubular substrates at a contact temperature with each substrate;

at least one of the interior and exterior tubular substrates has a thermal conductivity of at least 10 W/m-K, at least one of the interior and exterior tubular substrates has one of the following: a contact angle with the molten alloy capable of forming the metallic glass object of more than 90° at a contact temperature, and a surface roughness in a contact surface with a melt having an average surface asperity height of less than 1 μm;

and at least one of the interior and exterior substrates is configured to cool the molten alloy.

9. A method of forming a metallic glass object, the method comprising:

heating an alloy capable of forming a metallic glass to form a molten alloy; depositing the molten alloy at a constant deposition rate Q in a gap of thickness t separating a first substrate and a second substrate, where the first and second substrates are configured to move relative to each other at a velocity $V_o$; and cooling the extracted molten alloy with at least one of the first substrate and the second substrate;

wherein the deposition is along an overlapping cross section between the first substrate and second substrate having width w that is perpendicular to the direction of $V_o$;

wherein temperatures of the first substrate and second substrate are below a nose temperature of the metallic glass, wherein the gap thickness t is less than $\sqrt{(\alpha \cdot \tau_{cr})}$, where a is the thermal diffusivity of a melt and $\tau_{cr}$ is the minimum crystallization time of the metallic glass alloy;

wherein the second substrate has at least one of the following: a contact angle with the molten alloy capable of forming the metallic glass object of more than 90° at a contact temperature, and a surface roughness in a contact surface with the melt having an average surface asperity height of less than 1 μm;

wherein the relative velocity $V_o$ is in the range of $0.1\alpha/t$ to $10000\alpha/t$; and wherein the deposition rate Q is within 20% of the product $(V_o \times t \times w)$.

10. The method of claim 9, wherein the deposition rate Q is in the range of $0.1\alpha w$ to $10000\alpha w$.

11. The method of claim 9, wherein the relative velocity $V_o$ is in the range of 0.1 mm/s to 10 m/s.

12. The method of claim 9, wherein the deposition rate Q is in the range of $10^{-10}$ $m^3/s$ to $10^{-2}$ $m^3/s$.

13. The method of claim 9, wherein the gap thickness t is less than a critical casting thickness of the metallic glass alloy.

14. The method of claim 9, wherein the gap thickness t is in the range of 0.1 mm to 1 mm.

15. The method of claim 9, wherein a shearing rate of the molten alloy between the substrates is less than the ratio $V_o/t$.

16. The method of claim 9, wherein a skin friction coefficient at an interface between the melt and a contact surface of at least one of the first substrate and the second substrate is less than $\eta/\rho V_o t$, where $\eta$ is the melt viscosity and $\rho$ is the melt density.

17. The method of claim 9, wherein at least one of the first substrate and the second substrate is held at a temperature lower than a glass transition temperature of the metallic glass.

18. The method of claim 9, wherein a melt temperature of the alloy prior to being deposited is heated to a temperature of at least 100° C. higher than $T_L$.

19. The method of claim 9, wherein a temperature of the molten alloy between the first and second substrates reaches a steady state.

20. A method for forming a metallic glass tube, the method comprising:

heating an alloy capable of forming a metallic glass to form a molten alloy;

depositing the molten alloy at a deposition rate Q in an annular gap of thickness t separating two substantially concentrically arranged tubular substrates of circumferences $w_i$ and $w_o$, where $w_o > w_i$, along either $w_o$ or $w_i$, wherein a temperature of the tubular substrates is below a nose temperature of the metallic glass;

wherein the tubular substrates are configured to move relative to each other at a velocity $V_o$;

cooling the deposited molten alloy with at least one of the tubular substrates;

wherein the gap thickness t is less than $\sqrt{(\alpha \cdot \tau_{cr})}$, where a is the thermal diffusivity of a melt and $\tau_{cr}$ is the minimum crystallization time of the metallic glass alloy;

wherein one of the two substantially concentrically arranged tubular substrates has at least one of the following: a contact angle with the molten alloy capable of forming the metallic glass object of more than 90° at a contact temperature, and a surface roughness in a contact surface with the melt having an average surface asperity height of less than 1 μm;

wherein the relative velocity $V_o$ is in the range of $0.1\alpha/t$ to $10000\alpha/t$; and wherein the deposition rate Q is within 20% of the product $(V_o \times t \times w)$, where w is a mean tube circumference given by $w=(w_o+w_i)/2$.

* * * * *